US011459794B2

(12) United States Patent
Derham

(10) Patent No.: US 11,459,794 B2
(45) Date of Patent: Oct. 4, 2022

(54) DOOR LOCK ASSEMBLY

(71) Applicant: MIGHTON PRODUCTS LIMITED, Saffron Walden (GB)

(72) Inventor: Michael Derham, Saffron Walden (GB)

(73) Assignee: Mighton Products Limited, Saffron Walden (GB)

( * ) Notice: Subject to any disclaimer, the term of this patent is extended or adjusted under 35 U.S.C. 154(b) by 315 days.

(21) Appl. No.: 16/881,881

(22) Filed: May 22, 2020

(65) Prior Publication Data

US 2020/0354991 A1 Nov. 12, 2020

Related U.S. Application Data

(63) Continuation of application No. PCT/GB2018/053396, filed on Nov. 23, 2018.

(30) Foreign Application Priority Data

Nov. 24, 2017 (GB) ..... 1719572

(51) Int. Cl.
*E05B 47/00* (2006.01)
*E05B 63/00* (2006.01)

(52) U.S. Cl.
CPC ..... *E05B 47/0012* (2013.01); *E05B 63/0065* (2013.01); *E05B 2047/002* (2013.01); *E05B 2047/0083* (2013.01)

(58) Field of Classification Search
CPC ..... E05B 47/0012; E05B 63/0065; E05B 2047/002; E05B 2047/0083;
(Continued)

(56) References Cited

U.S. PATENT DOCUMENTS 6,062,612 A 5/2000 Lin
6,334,636 B1 1/2002 Huang
(Continued)

FOREIGN PATENT DOCUMENTS

DE 3606531 A1 9/1987
EP 0 373 232 A1 6/1990
(Continued)

OTHER PUBLICATIONS

International Search Report and Written Opinion, International Application No. PCT/GB2018/053396, dated Feb. 28, 2019 (10 pages).
(Continued)

*Primary Examiner* — Tai T Nguyen
(74) *Attorney, Agent, or Firm* — Burr & Brown, PLLC

(57) ABSTRACT

The present invention provides a motorised door lock assembly 10 in order for a user to be able to lock and unlock a door remotely and/or with a conventional key or with a thumb turn 22 from the inside. In particular, a user may decide to continue to use a key from the outside and the thumb turn (or an internal key mechanism) from the inside but at any stage the user (or a different user) may decide to operate the lock remotely. The motorised system may be activated by a number of actuators and, in particular, the motorised system may be activated by a remote key fob, a smart phone, an internally mounted push button or an external key pad. The assembly of the present invention is able to provide a continuous choice of all three methods (where permitted) without the risk of the lock becoming stuck in one position and without the user having to perform an elaborate particular sequence to operate the lock. The present invention is particularly for use with a Euro cylinder lock combined with a multipoint locking system 14 which thereby has operating limitations. The remotely activated
(Continued)

motorised mechanism comprises a motor 50, a worm gear 52, a driven gear 54, rotary locking spindle engagement means 30 to transmit movement of the motor 50 to a rotary locking spindle of the cylinder lock, and a remote control actuator, the remotely activated motorised mechanism further comprising a multipoint monitoring system to determine an operational status of the multipoint locking mechanism and a rotary lock bolt monitoring system to determine an operational status of the lock bolt; and wherein the rotary locking spindle engagement means is arranged to directly engage a component of a thumb turn mechanism of a door lock.

20 Claims, 17 Drawing Sheets

(58) Field of Classification Search
CPC ..... E05B 2001/0076; E05B 2047/0067; E05B 2047/0069
USPC ..... 70/277
See application file for complete search history.

(56) References Cited

U.S. PATENT DOCUMENTS

| | | | | |
|---|---|---|---|---|
| 7,364,212 | B1 * | 4/2008 | Fan | E05B 1/003 292/336.3 |
| 9,222,286 | B2 * | 12/2015 | Uyeda | E05B 63/16 |
| 2002/0084656 | A1 | 7/2002 | Lin | |
| 2008/0127686 | A1 * | 6/2008 | Hwang | E05B 47/0012 340/5.6 |
| 2010/0127517 | A1 | 5/2010 | Bliding | |

FOREIGN PATENT DOCUMENTS

| | | | |
|---|---|---|---|
| EP | 0 676 518 | A2 | 10/1995 |
| WO | 03/058013 | A1 | 7/2003 |

OTHER PUBLICATIONS

British Search Report, GB Application No. 1719572.8, dated May 17, 2018 (4 pages).

* cited by examiner

DOOR LOCK ASSEMBLY

FIELD OF THE INVENTION

The present invention relates to a motorised door lock assembly, a door comprising a motorised door lock assembly and a method of securing a motorised door lock assembly to a door. In particular, the present invention relates to a remotely activated motorised door lock assembly, a door comprising a remotely activated motorised door lock assembly and a method of converting a door to have a remotely activated motorised door lock.

BACKGROUND TO THE INVENTION

A door lock generally includes a lock bolt mounted on the edge of the door which is moved into and out of engagement with a locking recess provided in a door frame. A rotary locking spindle is arranged to be turned in order to move the locking bolt. This rotary locking spindle may be turned externally by a key or internally through the use of a thumb turn.

The door lock may additionally be secured through a multipoint locking system. This system bolts the door to the frame at multiple points and uses the door handle to move the locking elements into and out of position. Generally, the door handle is raised to simultaneously move the multipoint locking elements into position and the key (or thumb turn) then engages the lock bolt and this also locks the position of the multipoint locking elements. The multipoint locking elements can be subsequently retracted by moving the handle downwardly only after the key (or thumb turn) has released the lock bolt. Accordingly, these types of door use two manually operated locking mechanisms, i.e. externally using the key and the door handle and/or internally using the thumb turn and the door handle.

Door locks may be arranged to incorporate a motor to move the lock bolt into and out of a locked position. These may comprise a simple motor which is powered to move the locking bolt into the locked position. The motor may then be operated in reverse to retract the bolt. The lock bolt of such motorised locks should be able to be operated independently using either the key/thumb turn or the motor. Accordingly, the rotation of the key/thumb turn which rotates the rotary locking spindle may simultaneously rotate the motor. Alternatively, a clutch system may be used such that the motor is not rotated when the rotary locking spindle is manually rotated. In these systems a control and feedback system may be required to determine the position of the lock bolt to ensure that the motor is not operable to over-extend or over-retract the lock bolt. Such a situation may occur where the motor attempts to drive the lock to the extended locked position when a user had already manually moved the locking bolt into the locked position.

The rotary locking spindle of a cylinder lock may be rotatable through a 90 degree angle between the unlocked and the locked position. At each of these two separate positions, the key can be removed (and/or inserted). Accordingly, it is relatively easy to feedback the locked/unlocked positions since the rotary spindle is either in the first position or has been rotated through a 90 degree angle to the second position. However, with other cylinder locks, and in particular with Euro cylinder locks, the rotary spindle can be continuously rotated and the key is only insertable and retractable at the same single position. In this arrangement, the key is used to rotate the cylinder through 360 degrees between the locked position and the unlocked position.

Accordingly, a simple positional sensor to feedback the position of the locking spindle will not be able to indicate whether the lock bolt is extended or retracted.

Furthermore, the rotary locking spindle is only rotatable once the multipoint locking system has been activated. Again, there is a risk that a user attempting to remotely operate the motor to drive the locking bolt may cause the motor (or a part of the transmission/gear system) to become damaged or jammed.

It is an aim of the present invention to overcome at least one problem associated with the prior art whether referred to herein or otherwise.

SUMMARY OF THE INVENTION

According to a first aspect of the present invention there is provided a door lock assembly comprising a cylinder lock, a multipoint locking mechanism and a remotely activated motorised mechanism, the multipoint locking mechanism being activated by raising a door handle and the multipoint locking mechanism being deactivated by lowering the door handle, wherein a lock bolt of the cylinder lock is extendable and retractable by each of a key, a manual turn of a thumb turn grip or the remotely activated motorised mechanism, the lock bolt only being extendable whilst the multipoint locking mechanism is engaged and the multipoint locking mechanism only being releasable whilst the lock bolt is retracted, wherein the remotely activated motorised mechanism comprises:

- a motor,
- a worm gear,
- a driven gear, and
- rotary locking spindle engagement means to transmit movement of the motor to a rotary locking spindle of the cylinder lock,
- the remotely activated motorised mechanism further comprising a multipoint monitoring system to determine an operational status of the multipoint locking mechanism and a rotary lock bolt monitoring system to determine an operational status of the lock bolt; and
- wherein the rotary locking spindle engagement means is arranged to directly engage a component of a thumb turn mechanism of a door lock.

Preferably the remotely activated motorised mechanism comprises a remote control actuator.

Preferably the rotary locking spindle engagement means is arranged to directly engage a component of an existing and/or preinstalled thumb turn mechanism of the door lock.

The rotary locking spindle engagement means may be arranged to directly engage a grip of the thumb turn mechanism. The engagement means may encapsulate a grip of the (existing and/or preinstalled) thumb turn mechanism.

The rotary locking spindle engagement means may be arranged to directly engage a rotating spindle of the thumb turn mechanism.

The rotary locking spindle engagement means may be arranged to directly engage an internally projecting portion (stub) of a rotary locking spindle of the cylinder lock and preferably of an existing and/or preinstalled cylinder lock.

Preferably the rotary locking spindle engagement means comprises an engagement sleeve. Preferably the engagement sleeve is arranged to directly engage around a rotary locking spindle and more preferably around a Euro lock rotary locking spindle.

The engagement sleeve may provide an internal bore into which an end of a rotary locking spindle may be engaged. The sleeve may provide one and preferably two securement apertures which may be offset around the sleeve by 180 degrees. Preferably a securement element (screw/grub screw) is arranged to project through the first aperture and through the rotary locking spindle and into the second aperture.

The engagement sleeve may comprise an outer splined surface. The door lock assembly may comprise an internal cylindrical splined surface for direct engagement around the engagement sleeve. The internal cylindrical splined surface may be provided on a transmission element.

The transmission element may be fixed to rotate with the thumb turn and the rotary locking spindle. The driven gear may be fixed to rotate with the motor (or a drive shaft of the motor). Drive from the motor may be transferred to the rotary locking spindle through the engagement the driven gear with the transmission element though a clutch mechanism.

Preferably the transmission element is rotated through 180 degrees in order to change the state of the lock bolt and preferably to move the lock bolt between the open position and the closed position.

The transmission element may be engaged with the driven gear through a clutch mechanism. The clutch mechanism may enable the transmission element to rotate with the driven gear and also to rotate relative to the driven gear.

The clutch mechanism may be internally located between the transmission element and the driven gear.

The transmission element may comprise a shaped boss which is located between two parallel resilient members secured to the driven gear. The shaped boss is arranged to rotate with the resilient members until a threshold resistance to rotation is encountered at which point the shaped boss may rotate within (between) the two parallel resilient members. The threshold resistance may occur as a result of the driven gear attempting to rotate a worm engaged with a motor.

Preferably the cylinder lock comprises a Euro cylinder lock.

Preferably rotation of the rotary locking spindle is arranged to move the lock bolt translationally between the locked position and the unlocked position.

The motorised mechanism may comprise control means. The control means may permit or prevent the activation of the motor. The control means may record the current configuration of the multipoint locking mechanism and may record the current configuration of the lock bolt.

The worm gear may comprise a worm provided on a shaft of a motor and a worm wheel. The worm wheel may be provided on a compound gear which may locate between the worm and the driven gear.

The motorised mechanism may comprise an electric motor and may comprise a power supply. The power supply may comprise batteries which may be selectively located within an accessible battery chamber provided in a housing.

Preferably the multipoint monitoring system determines whether locking elements of the multipoint locking mechanism are in a locked position or in an unlocked position.

The multipoint monitoring system may monitor (record) the movement of a handle shaft to which an internal door handle is mounted. The multipoint monitoring system may record whether the handle shaft has been rotated to indicate whether the multipoint locking system has been activated or deactivated.

The handle shaft may comprise a shaped boss. Preferably movement of the handle downwardly from a neutral position causes the shaped boss to activate a first sensor and movement of the handle upwardly from a neutral position causes the shaped boss to activate the second sensor. Preferably each sensor comprises a micro switch which is arranged to close when activated. Preferably in the neutral position both the first sensor (micro switch) and the second sensor (micro switch) are open.

The door lock assembly may comprise urging means to urge the door handle towards the neutral position from the raised position and/or the lowered position. Preferably the door handle automatically returns to the neutral position once a user releases the door handle.

The activation of the multipoint locking system may automatically activate the motorised mechanism and may move the lock bolt to the locked position.

Preferably the rotary locking spindle monitoring system determines whether the rotary locking spindle is in the locked (and unlocked position) which preferably indicates whether the lock bolt is locked (or unlocked).

The door lock assembly may comprise a shaft secured to the rotary locking spindle and the shaft may comprise a shaped boss. Preferably the shaped boss is engaged with a first sensor and a second sensor. Preferably the first sensor and the second sensor comprise micro switches. Preferably the shaped boss provides a cam surface which is arranged to close the micro switches. Preferably movement of the rotary locking spindle to a locking position provides a locking sensor sequence (order of opening/closing the micro switches) and movement of the rotary locking spindle to an unlocking position provides an unlocking sensor sequence (order of opening/closing the micro switches).

Preferably the shaped boss is provided by a transmission element.

Preferably the first micro switch and the second micro switch are in the same state (preferably both open) in both the locked position and the unlocked position. Preferably the control means relies on the operating sequence of the micro switches to record whether the lock bolt is in the locked position or the unlocked position.

Preferably a key is only insertable and removable from a key slot (preferably an external key slot) in the locked position and the unlocked position. Preferably the key has to be initially inserted and then rotated though substantially 360 degrees to lock the lock bolt and to subsequently remove the key (or to unlock the lock bolt and subsequently remove the key).

Preferably the key has to be initially inserted and then rotated though substantially 360 degrees to change the state of the lock bolt and to subsequently remove the key. This 360 degree rotation may activate a first micro switch and then a second micro switch and then deactivate the first micro switch and then deactivate the second micro switch and this sequence of activation/deactivation may enable the control means to distinguish and record a locking status of the lock bolt.

Preferably the assembly comprises a control system which monitors the operational statuses of the multipoint locking elements and the lock bolt.

Preferably the control system monitors the direction of rotation of the rotary spindle.

Preferably the rotary spindle is rotatable by a key through 360 degrees between the locked position and the unlocked position and preferably the rotary locking spindle is rotatable by the motor and/or thumb turn through 180 degrees between the locked position and the unlocked position.

The remotely activated motorised mechanism may be activated by a plurality of individual activators and preferably by a smart phone, a remote control unit, a push button, a key fob or a key pad. Preferably the remotely activated motorised mechanism may be activated by each of a plurality of individual activators and preferably by each of a smart phone, a remote control unit, a push button, a key fob or a key pad. The push button may be mounted on a housing (preferably an internal housing) of the door lock assembly.

The door lock assembly may comprise a housing which is arranged to be mounted on an internal side of a door. Preferably the housing is arranged to be mounted on an internal side of the door and engages with an existing rotary lock spindle and an existing door handle spindle. Preferably the housing is arranged to be mounted on an internal side of the door and over an existing rotary lock spindle and an existing door handle spindle.

The door lock assembly may comprise a mounting plate to enable the door lock assembly to be secured to pre-existing securement fittings. The mounting plate may provide a first series (set/pair) of securement apertures and a second series (set/pair) of securement apertures. The first series of securement apertures may be spaced apart by a first distance and the second series of securement apertures may be spaced apart by a second distance which is greater than the first distance. Securement elements (screws/bolts) may be arranged to pass through the securement apertures to secure the door lock housing to pre-existing securement receiving portions (bores) provided by a door. For a first configuration, securement elements may extend from a front of the housing through the first securement apertures and into the door (receiving portions/bores in the door). In a second configuration, securement elements may extend from a front of the housing and terminate at the first securement apertures of the housing plate and further securement elements extend from the second securement apertures into securement receiving portions (bores) provided by the door.

Preferably the rotary locking spindle engagement means comprises a first engagement sleeve dimensioned to receive a pre-existing rotary locking spindle of a first dimension and a second engagement sleeve to receive a pre-existing rotary locking spindle of a second dimension. Preferably a first engagement sleeve provides an engagement bore of a first diameter and a second engagement sleeve provides an engagement bore of a second (larger) diameter and this may enable the door lock assembly to be secured to different pre-existing door locks.

According to a second aspect of the present invention there is provided a motorised door lock assembly for use with a door having a cylinder lock and a multipoint locking mechanism, the motorised door lock assembly comprising a remotely activated motorised mechanism, wherein the motorised door lock assembly enable a lock bolt of the cylinder lock to be extendable and retractable by each of a key, a manual turn of a thumb turn grip or the remotely activated motorised mechanism, wherein the remotely activated motorised mechanism comprises:

a motor, a worm gear, a driven gear, rotary locking spindle engagement means to transmit movement of the motor to a rotary locking spindle of the cylinder lock, and a remote control actuator, the remotely activated motorised mechanism further comprising a multipoint monitoring system to determine an operational status of the multipoint locking mechanism and a rotary lock bolt monitoring system to determine an operational status of the lock bolt; and wherein the rotary locking spindle engagement means is arranged to directly engage a component of a thumb turn mechanism of a door lock.

According to a third aspect of the present invention there is provided a method of converting an existing door lock to a motorised door lock comprising securing a door lock assembly to the existing door lock wherein the door lock assembly is in accordance with the first aspect of the present invention.

According to a fourth aspect of the present invention there is provided a door comprising a door lock assembly in accordance with the first aspect of the present invention.

According to a fifth aspect of the present invention there is provided a kit for converting an existing door lock to a motorised door lock wherein the door lock assembly is in accordance with the first aspect of the present invention.

Preferably the kit comprises a mounting plate which adapts the position of securement elements (for securing the door lock assembly to a door with a pre-existing door lock) from a first configuration to a second configuration.

Preferably the kit comprises a plurality of engagement sleeves to enable pre-existing rotary locking spindles of differing dimensions to be securely engaged.

According to a sixth aspect of the present invention there is provided a remotely activated motorised mechanism for use with a door lock assembly wherein the door lock assembly is in accordance with the first aspect of the present invention.

According to a further aspect of the present invention there is provided a door lock assembly comprising a cylinder lock, a multipoint locking mechanism and a remotely activated motorised mechanism, the multipoint locking mechanism being activated by raising a door handle and the multipoint locking mechanism being deactivated by lowering the door handle, wherein a lock bolt of the cylinder lock is extendable and retractable by each of a key, a thumb turn grip or the remotely activated motorised mechanism, the lock bolt only being extendable after the activation of the multipoint locking mechanism and the multipoint locking mechanism only being deactivatable after the retraction of the lock bolt, wherein the remotely activated motorised mechanism comprises:

a motor, a worm gear, a driven gear, rotary spindle engagement means to transmit movement of the motor to a rotary spindle of the cylinder lock, and a remote control actuator, the remotely activated motorised mechanism further comprising a multipoint monitoring system to determine an operational status of the multipoint locking mechanism and a rotary spindle monitoring system to determine an operational status of the rotary spindle;

wherein the rotary spindle engagement means is arranged to directly engage a component of a thumb turn mechanism of the door lock; and wherein a key is only insertable and removable from a key slot of the cylinder lock when the key slot is at a single rotational position.

Preferably the key is only insertable and removable from key slot of the cylinder lock when the key slot is at a single rotational position.

Preferably rotation of the thumb turn does not rotate the key slot.

Preferably rotation of the motor is does not rotate the key slot.

Preferably rotation of the key whilst engaged in the key slot is arranged to rotate the thumb turn.

Preferably rotation of the key whilst engaged in the key slot is arranged to rotate a transmission element.

The mechanism may comprise feedback means to determine the operable state of the door handle.

According to another aspect of the present invention there is provided a door lock assembly comprising a cylinder lock, a multipoint locking mechanism and a remotely activated motorised mechanism, the multipoint locking mechanism being activated by raising a door handle and the multipoint locking mechanism being deactivated by lowering the door handle, wherein a lock bolt of the cylinder lock is extendable and retractable by each of an internal key mechanism, an external key mechanism or the remotely activated motorised mechanism, the lock bolt only being extendable whilst the multipoint locking mechanism is engaged and the multipoint locking mechanism only being releasable whilst the lock bolt is retracted, wherein the remotely activated motorised mechanism comprises:

a motor, a worm gear, a driven gear, rotary locking spindle engagement means to transmit movement of the motor to a rotary locking spindle of the cylinder lock, and a remote control actuator, the remotely activated motorised mechanism further comprising a multipoint monitoring system to determine an operational status of the multipoint locking mechanism and a rotary lock bolt monitoring system to determine an operational status of the lock bolt; and wherein the rotary locking spindle engagement means is arranged to directly engage a component of the internal key mechanism of the door lock.

According to an additional aspect of the present invention there is provided a door lock assembly comprising a cylinder lock and a remotely activated motorised mechanism, wherein a lock bolt of the cylinder lock is extendable and retractable by each of an internal mechanism, an external key mechanism or the remotely activated motorised mechanism, rotary locking spindle engagement means to transmit movement of the motor to a rotary locking spindle of the cylinder lock, and a remote control actuator, the remotely activated motorised mechanism further comprising a lock bolt monitoring system to determine an operational status of the lock bolt; and wherein the rotary locking spindle engagement means is arranged to directly engage a component of the internal mechanism of the door lock.

Preferably the remotely activated motorised mechanism comprises a motor, a worm gear, a driven gear, and rotary locking spindle engagement means to transmit movement of the motor to a rotary locking spindle of the cylinder lock.

According to a yet further aspect of the present invention there is provided a method of converting an existing door lock to a motorised door lock comprising securing an internal door lock assembly to an internal side of a door and engaging a component of a thumb turn mechanism of the existing door lock directly to the motorised door lock assembly.

The method may comprise removing a thumb turn grip form the existing door lock assembly and directly engaging the motorised door lock assembly with an exposed portion of a thumb turn spindle.

Preferably the method comprises retaining an external locking mechanism of the existing door lock assembly. Preferably the method comprises retaining a Euro cylinder lock of the existing door lock assembly. Preferably the method comprises retaining an external handle of the existing door lock assembly.

Preferably the motorised door lock assembly is in accordance with the first aspect of the present invention.

According to a yet further aspect of the present invention there is provided a door lock assembly comprising a cylinder lock, a multipoint locking mechanism and a motorised mechanism, the multipoint locking mechanism being activated by raising a door handle and the multipoint locking mechanism being deactivated by lowering the door handle, wherein a lock bolt of the cylinder lock is extendable and retractable by each of a key, a manual turn of a thumb turn grip or the motorised mechanism, the lock bolt only being extendable whilst the multipoint locking mechanism is engaged and the multipoint locking mechanism only being releasable whilst the lock bolt is retracted, wherein the motorised mechanism comprises:

a motor, a worm gear, a driven gear, and rotary locking spindle engagement means to transmit movement of the motor to a rotary locking spindle of the cylinder lock, the motorised mechanism further comprising a multipoint monitoring system to determine an operational status of the multipoint locking mechanism and a rotary lock bolt monitoring system to determine an operational status of the lock bolt; and wherein the rotary locking spindle engagement means is arranged to directly engage a component of a thumb turn mechanism of a door lock.

Preferably the multipoint monitoring system comprises positional sensors to monitor whether the multipoint locking elements are in an engaged position or a disengaged position. The multipoint monitoring system may change from a first state (to indicate the engaged position) to a second state (to indicate the disengaged position).

Preferably the rotary lock bolt monitoring system comprises positional sensors to monitor whether the lock bolt is in an engaged position or a disengaged position. The rotary lock bolt monitoring system may change from a first state (to indicate the engaged position) to a second state (to indicate the disengaged position).

BRIEF DESCRIPTION OF THE DRAWINGS

The present invention will now be described by way of example only with reference to the drawings that follow, in which:

FIG. 9 is a side view of at least a part of a gear mechanism of a preferred embodiment of a motorised door lock assembly in the configuration shown in

FIG. 1A;

DESCRIPTION OF THE PREFERRED EMBODIMENTS

Figures 1A, 1B, 1C, 1D:
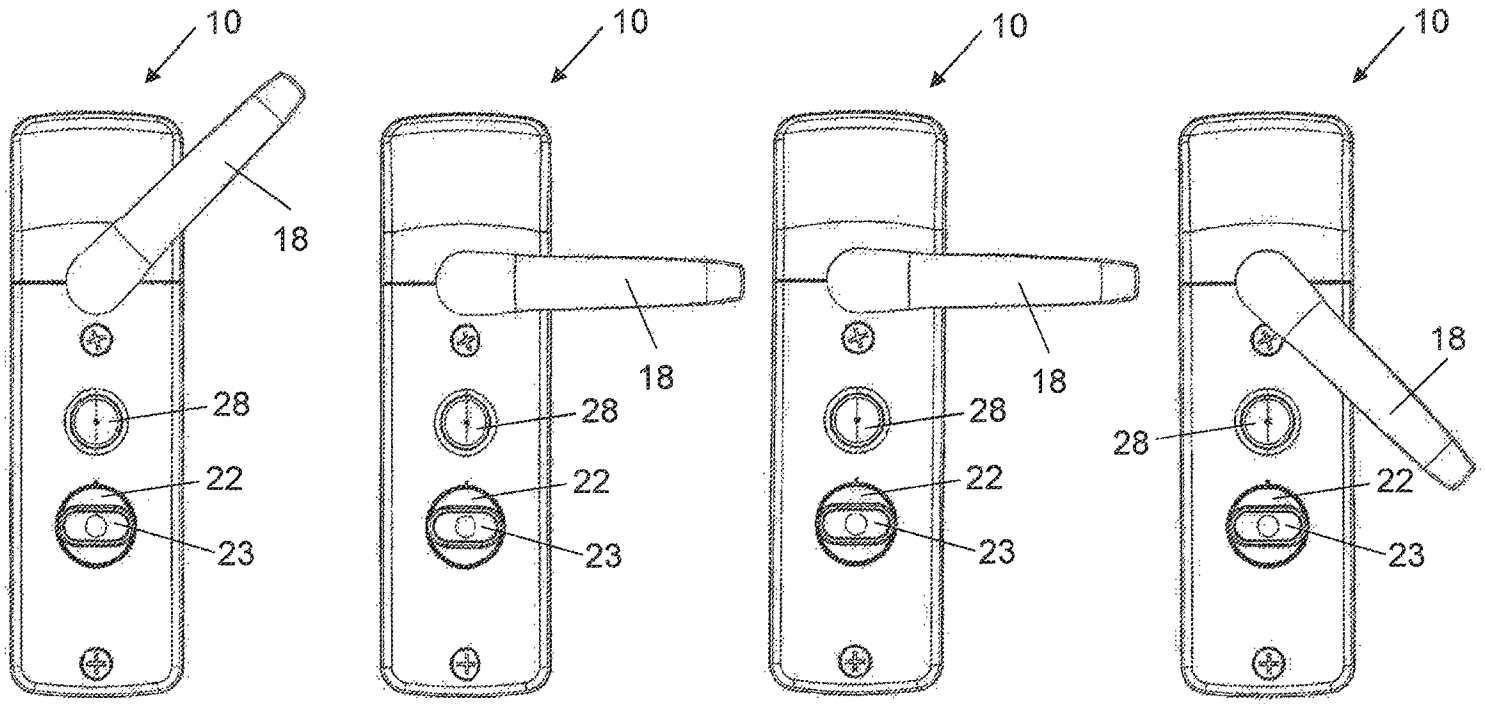
FIGS. 1A to 1D is front view of a preferred embodiment of a motorised door lock assembly with the multipoint elements engaged and the lock bolt disengaged (1A), the multi point elements and the lock bolt engaged (1B), the multi point elements engaged and the lock bolt disengaged (1C) and the multi point elements and the lock bolt disengaged.

The present invention provides a motorised door lock assembly 10 in order for a user to be able to lock and unlock a door remotely and/or with a conventional key or with a thumb turn 22 from the inside. One aim of the present invention is to provide the ability to remotely operate a motorised system to lock and unlock the door in order to supplement the conventional manual methods. In particular, a user may decide to continue to use a key from the outside and the thumb turn (or an internal key mechanism) from the inside but at any stage the user (or a different user) may decide to operate the lock remotely. The motorised system may be activated by a number of actuators and, in particular, the motorised system may be activated by a remote key fob, a smart phone, an internally mounted push button or an external key pad. One advantage of the present invention is that a user may no longer be required to carry keys all the time.

The assembly of the present invention is able to provide a continuous choice of all three methods (where permitted) without the risk of the lock becoming stuck in one position and without the user having to perform an elaborate particular sequence to operate the lock.

The present invention is particularly for use with a Euro cylinder lock combined with a multipoint locking system 14 which thereby has operating limitations. In such a combination, a door incorporates a Euro cylinder lock operating a primary lock bolt and a separate door handle 18 which must be raised in order to engage a number of individual locking elements which only then allows the primary lock bolt to be engaged within a recess in the door frame. Conversely, in order to unlock the door, the primary lock bolt must be retracted from the locking recess by rotation of a rotary locking spindle (rotary core) of the Euro cylinder lock and then the door handle 18 is movable downwardly which disengages the individual locking elements and allows the door to be opened.

The raising and lowering of the door handle 18 operates the multiple locking elements which are located spaced from the Euro cylinder operated lock bolt. For example, the multipoint locking elements may include hook bolts and/or compression bolts located on the edge of the door and/or top/bottom of the door. These further locking points increase the security of the door and may also help to pull the door tightly into the frame in order to improve a weather seal.

Accordingly, the operating mechanism for such doors including Euro cylinder locks includes a first step by which the multipoint locking elements are engaged through the raising of the door handle 18 and this is subsequently followed by the conventional use of a key or the internal thumb grip 22. Conversely, the opening of the door is also a two-step procedure with the Euro cylinder lock bolt initially being retracted and then the multi point locking elements being retracted by the operation of the door handle 18.

The present invention provides a motorised assembly in order to replace and/or supplement the internal thumb grip 22 for the door and the external locking mechanism/handle/lever is untouched. This helps to reduce the cost of the device. In addition, the present invention can be easily fitted retrospectively to an already installed mechanism which is operating correctly. However, a problem with simply installing a motorised assembly to the thumb grip is that there are several configurations between the positions of the manual door handle 18 which can interfere with and/or confuse a motorised lock assembly. Motorised lock assemblies may be incorporated into doors which solely rely on a single deadlock bolt and these will not encounter the problems with the requirement for the multipoint lock system to be in a dedicated position which is further complicated by the restrictions of using a Euro cylinder lock (as explained below).

In addition, Euro cylinder locks are designed such that the key can only be inserted and extracted from the key slot in one position. Accordingly, the key and rotary locking spindle must be rotated through 360° when moving the lock bolt from the open position to the closed position or from the closed position to the open position. Other cylinder locks may enable the key to only rotate through 90° between the open and closed position and this thereby simplifies any gear mechanism and positional feedback system used within a motorised system.

Furthermore, a thumb turn with a Euro cylinder lock may only be required to be rotated through 180 degrees to move the lock bolt between the locked and unlocked positions. This further complicates the provision of a motorised system for such doors and, in particular, a motorised system that can be easily retrospectively fitted to an existing system without having to replace significant existing components of the installed door lock. The Euro cylinder lock includes an internal clutch system which is activated by the key which may enable the key to be freely rotated (with a rotary key spindle of the cylinder lock) prior to engaging the main rotary locking spindle. Such situations occur when the thumb turn in used to move the rotary locking spindle whilst the key is not engaged in the key slot since this rotation of the rotary locking spindle does not rotate the rotary key spindle.

The present invention retains the existing key mechanism on the external side and also utilises the existing thumb grip spindle on the inside such that the Euro cylinder lock can either be operated by the key or by the thumb turn grip 23 or by the motor 50. Accordingly, these three mechanisms must be independent and also be able to function independently of the position of the other two mechanisms.

A preferred embodiment of the present invention will now be described in more detail in which a motorised door lock assembly 10 is retrospectively fitted to an existing Euro cylinder door lock in combination with a multipoint locking system.

As shown in FIG. 1A to 1D, the door lock assembly comprises a housing 11 which is arranged to be secured on the internal side of a door whilst retaining the existing external hardware of the door locking mechanism. In particular, the present invention may retain the external door handle and spindle, the Euro cylinder lock and may only require the removal of the internal thumb grip (and internal door handle) to expose a stub or part of the rotary locking spindle of the Euro cylinder lock (and a door handle spindle).

The sequence of operation (from an unlocked position) requires a user to initially raise the internal door handle 18 (se FIG. 1A), this engages the multi lock elements. The raising of the handle 18 may also activate the motorised system to lock the main lock bolt and the handle 18 is urged back to the rest (horizontal position) as shown in FIG. 1B. A user can then selectively use a key fob, mobile phone or push button 28 to activate the (remotely activated) motorised system (or use the thumb turn) to unlock the main lock bolt and this retains the same configuration, as confirmed in FIG. 1C. Finally, a user must turn the handle 18 downwards (as shown in FIG. 1D) to disengage the multi lock elements and enable the door to be opened.

Figure 2C:
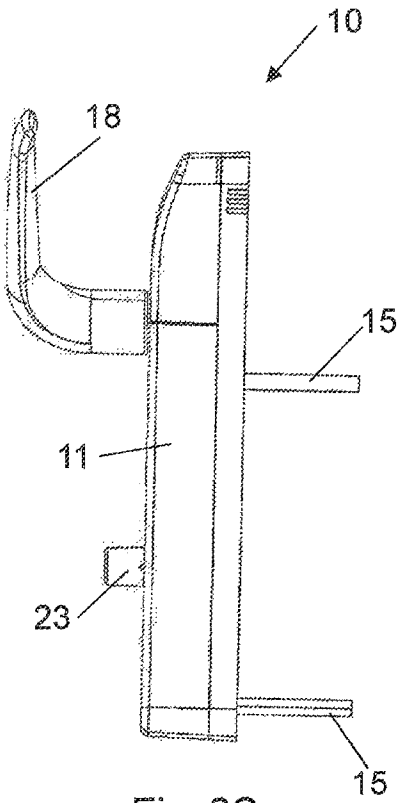
FIGS. 2A to 2C are rear perspective, rear and side views of a preferred embodiment of a motorised door lock assembly in the configuration shown in FIG. 1A.
Figure 2B:
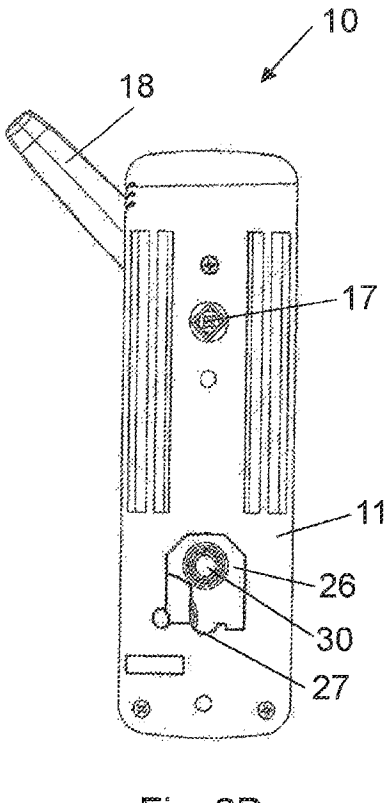
Figure 2A:
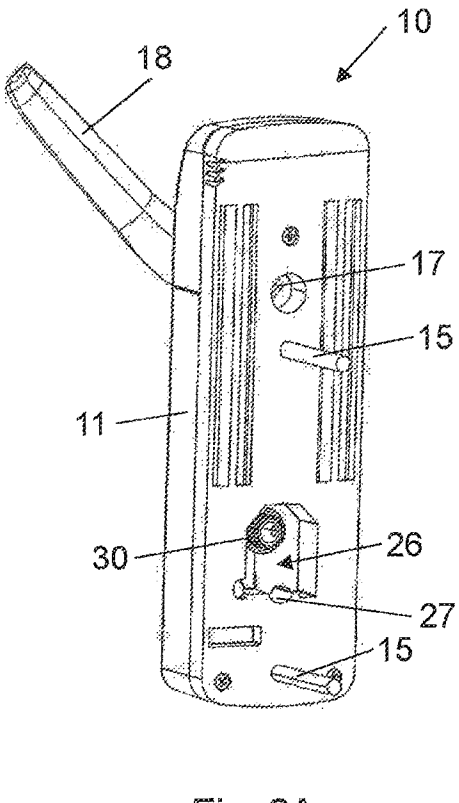

As shown in FIGS. 2A to 2C, the door lock assembly 10 comprises engagement means to directly engage with a component (spindle) of the existing thumb turn located on the internal side of the door. In a preferred embodiment, the engagement means comprises an engagement sleeve 30 which is secured directly to the end/stub of an existing/preinstalled thumb turn spindle which may be formed on the end of the rotary lock spindle of the Euro cylinder lock. In an alternative embodiment, the engagement means may fit over (encapsulate or encompass) and directly engage the pre-existing thumb turn grip such that the door lock assembly 10 can be simply mounted over the internal thumb turn grip.

The door handle assembly 10 comprises a housing 11 containing the mechanism whereby the housing 11 is arranged to be secured to the internal side of the door, for example by two screws 15. The door handle assembly 10 provides a handle 18 with an engagement aperture 17 which engages an existing spindle of the handle system. Accordingly, the present invention simply installs on the internal side without having complex components which must be incorporated into an existing door lock. This results in the assembly being quick and easy to retrospectively fit and is also cost efficient due to the lack of external locking components required. The assembly also has the benefit of being able to use an already operational lock system.

In the preferred embodiment, an existing internal thumb turn is removed from the existing door lock assembly in order for the motorised system to be mounted thereto. The motorised system provides a thumb turn 23 or at least a shaft 32 for the existing thumb turn grip to be reused. This enables the present invention to be retrospectively fitted to existing systems without interfering with the external locking system and/or without having to provide replacement components for the manual locking arrangement. Similarly, the present invention provides an internal door handle to replace the existing door handle or the door handle may be re-used and installed on the present invention.

Figure 13:
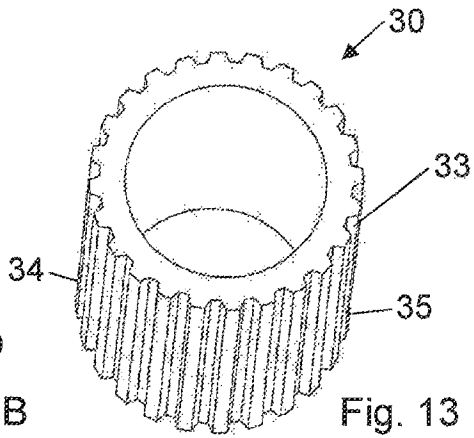
FIG. 13 is a perspective view of a preferred embodiment of a Euro lock spindle engagement sleeve of a preferred embodiment of a motorised door lock assembly.

In a preferred embodiment of the present invention, the engagement means comprises a splined sleeve 30 (see FIG. 13) (or coupling) which includes two circumferentially spaced apart fixing apertures 34, 35. A grub screw 36 (Allen grub screw) is arranged to be inserted through a first aperture 34 and then into and through a passageway in the thumb turn spindle and then to pass through and into the second aperture 35 in the splined sleeve 30. The external splined surface 33 of the sleeve 30 is arranged to engage with a transmission element 60 of the motorised system. The door lock assembly 10 may be used with splined sleeves of differing dimensions in order to fit pre-existing locking spindles of different dimensions (diameters).

The transmission element 60 comprises a cylindrical recessed portion 61 (see FIG. 11B) into which the splined sleeve 30 engages. The cylindrical recessed portion 61 provides an internal splined surface to cooperate with and engage the outer splined surface 33 of the sleeve 30.

Figure 3:
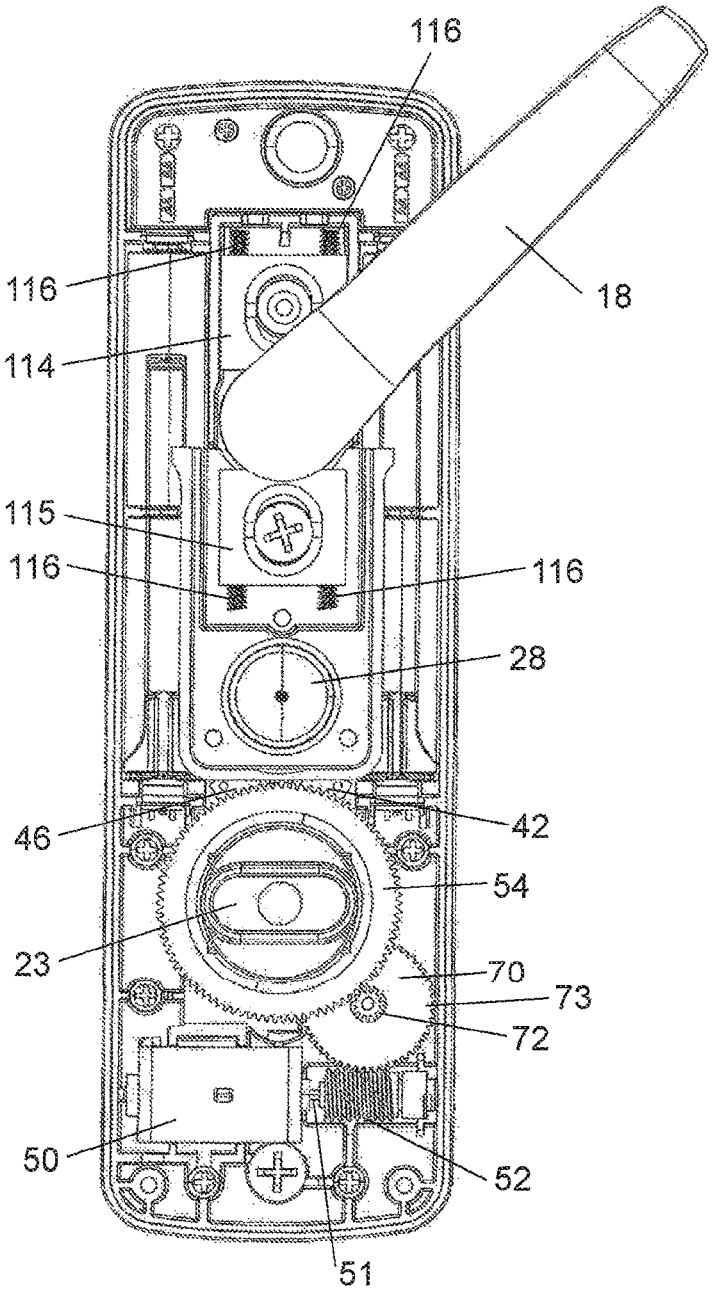
FIG. 3 is a partial front view of a preferred embodiment of a motorised door lock assembly in the configuration shown in FIG. 1A.
Figure 4:
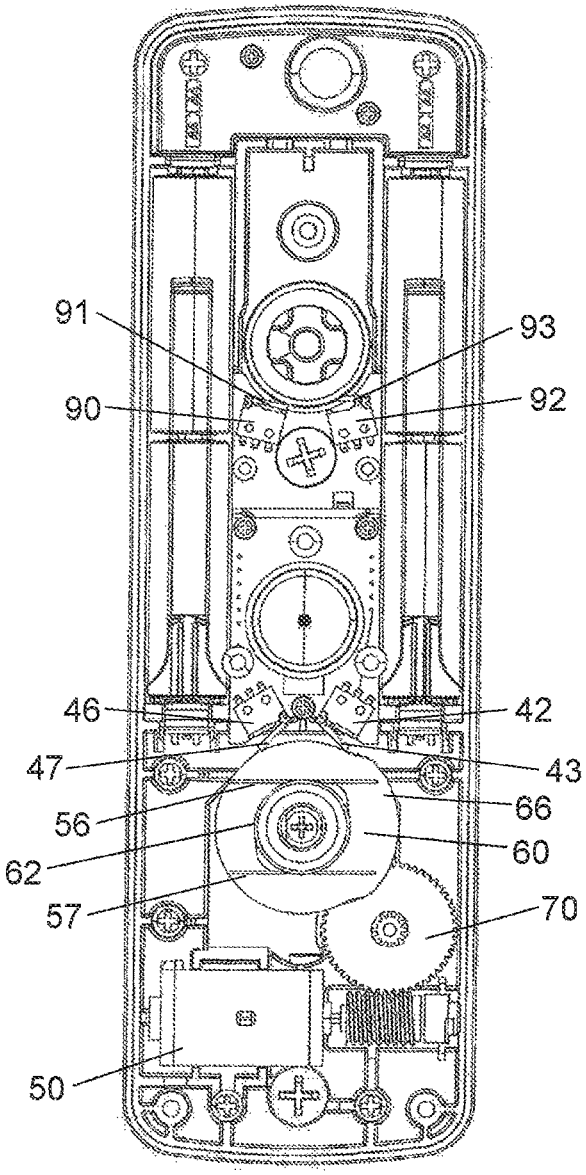
FIG. 4 is a partial front view of a preferred embodiment of a motorised door lock assembly in the configuration shown in FIG. 1A.

As shown in FIG. 3 and FIG. 4, the door handle assembly 10 comprises a lower motorised mechanism for moving the lock bolt and this also includes a position feedback system to determine the position of the lock bolt. In addition, the door handle assembly 10 comprises an upper feedback system to determine the position of the multi point locking elements which are controlled by the manual movement of the handle 18.

The lower motorised mechanism comprises a motor 50 together with a gear train (worm 52, intermediate gear 70 and driven gear 54) to drive a transmission element 60 engaged with the rotary lock spindle through the splined coupling.

Figure 11A:
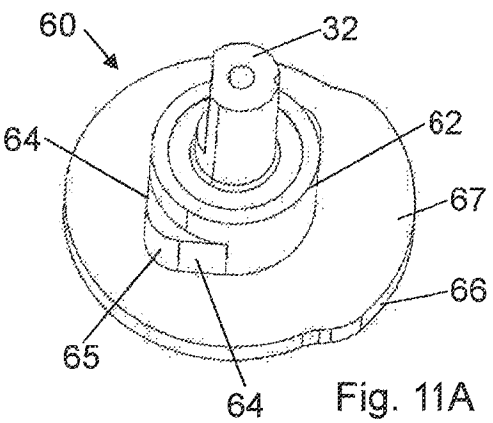
FIG. 11A is a front perspective view of a transmission element of a preferred embodiment of a motorised door lock assembly.
Figure 11B:
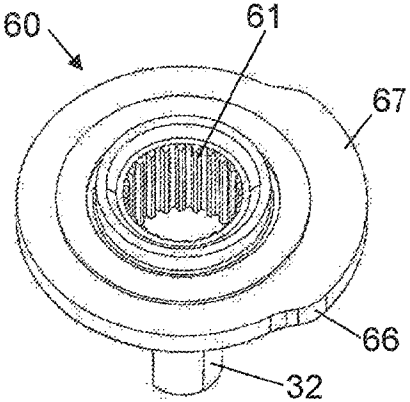
FIG. 11B is a rear perspective view of a transmission element of a preferred embodiment of a motorised door lock assembly.

As shown in FIG. 11A and FIG. 11B, the transmission element 60 provides a projecting shaft 32 which projects through the housing 11. A thumb turn grip 23 is arranged to be mounted on this projecting shaft 32. The projecting shaft 32 may have a flattened or planar surface corresponding with a similarly shaped surface within the engagement recess of the thumb turn grip 23. These corresponding flat surfaces prevent relative rotation between the thumb turn grip 23 and the shaft 32 such that the thumb turn grip 23 is arranged to rotate the projecting shaft 32. The thumb turn grip 23 can be manually gripped by a user in order to rotate the locking spindle in a conventional manner. In particular, the rotation of projecting shaft 32 will rotate the transmission element 60 which will thereby rotate the locking spindle.

The transmission element 60 is also engaged to the drive system such that the transmission element 60 can be rotated by a motor 50. The transmission element 60 is coupled to the drive system through a clutch mechanism. This thereby enables the locking spindle and the projecting shaft 32 to be rotated without this rotation being transmitted to the drive system and specifically to the motor 50. However, the clutch mechanism enables the drive system to rotate the lock spindle when the drive system is activated and the motor 50 is powered.

Figure 12A:
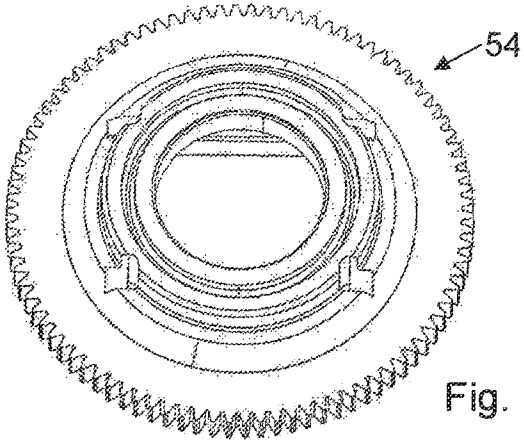
FIG. 12A is a front perspective view of a driven gear and clutch of a preferred embodiment of a motorised door lock assembly.
Figure 12B:
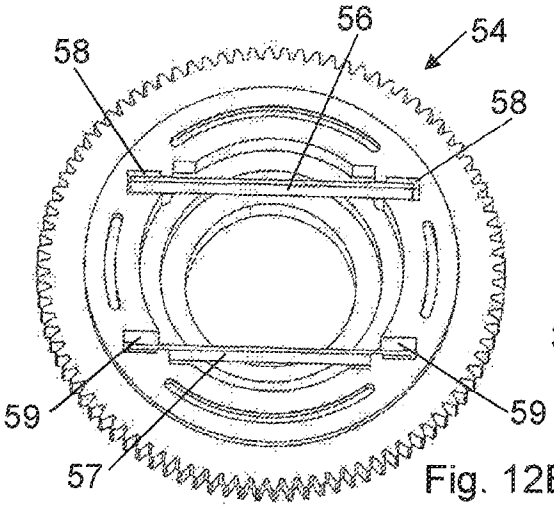
FIG. 12B is a rear perspective view of a driven gear and clutch of a preferred embodiment of a motorised door lock assembly.

The transmission element 60 is rotatably coupled to a driven gear 54 through a clutch system. In particular, two parallel resilient elements 56, 57 are mounted within respective recesses 58, 59 of the driven gear, as shown in FIG. 12A and FIG. 12B.

A boss portion 62 of the transmission element 60 locates between the two resilient elements 56, 57. The outer cylindrical surface of the boss 62 is not circular and provides a generally parallelogram cross section with rounded vertices 65. This thereby provides two pairs of opposing parallel surfaces 64 with rounded vertices 65 therebetween. The planar surfaces 64 are arranged to be engaged between the two resilient elements 56, 57 such that rotation of the resilient elements 56, 57 causes rotation of the transmission element 60. However, if there is a resistive force which opposes the relative rotation then the resilient elements 56, 57 will flex and the rounded vertices 65 will eventual rotate within the resilient elements 56, 57 and the transmission element 60 will be rotatable relative to the driven gear 54. This thereby provides the clutch functionality. This arrangement also provides a dwell angle (of approximately 90 degrees) within the clutch system.

The preferred clutch thereby comprises a two lobed cam attached to the Euro lock drive spindle which rotates between two leaf springs (resilient elements 56, 57). The leaf springs are attached to the driven gearwheel 54 which is rotated by the motor 50. The force of the springs is such that when the driven gearwheel 54 is rotated by the motor 50, the two-lobe cam is rotated with it. As mentioned above, the clutch does allow the Euro lock to be rotated by the user, even if the gearwheel 54 is prevented from being turned.

The clutch includes a "jamming feature" in the situation where the Euro lock becomes jammed then the motor 50 will not stall but the clutch will disengage the motor 50 to enable the motor 50 to continue and after a period of time this will be sensed and a notification will be sent to indicate that the lock is jammed. The present invention ensures that the user can always rotate the key to lock and unlock the door even if there is a mechanical failure (or power failure) which prevents the motor 50 or gearwheel 54 from rotating. This helps to provide a failsafe mechanism. The control system may use current/time sensing to determine if the drive system has stalled. By this technique, the control system can notify the user of a fault. However, as stated above, the user will always be able to use the key (and thumb turn) to lock or unlock the device.

The preferred arrangement of the drive mechanism is shown in FIG. 7 to FIG. 10.

The arrangement of the motorised mechanism comprising a worm 52 prevents the system from being back driven. That is to say that the motor 50 cannot be rotated by rotating the main drive wheel 54 (the drive gear 54 cannot be back driven). However as explained above, the clutch allows the user to rotate the key (or thumb turn) in either direction, even if the gearwheel/worm drive is jammed.

The outer circumference of the driven gear 54 is meshed with an intermediary gear 70. In particular, the intermediary gear 70 is a compound gear member 70. The compound gear member 70 provides a stepped gear mechanism (or double gear) whereby the gear ratio is selected to increase the rotational speed by a required amount.

The compound gear 70 provides a first smaller gear 72 which engages with the gear 54 coupled to the transmission element 60. In one specific embodiment, the first gear 72 has 12 teeth which engage with the driven gear 54 which has 90 teeth.

The compound gear 70 has a second larger gear 73 fixed on the same axle and which is rotatably mounted on a shaft 74 secured to the housing 11. In one specific embodiment, the larger gear 73 has 50 teeth. The second gear 73 provides a worm wheel which is meshed with a worm 52 of the drive system. In particular, the worm 52 is fixed to a drive shaft 51 of the motor 50.

Accordingly, the gear mechanism (gear train) comprises a worm 52 to worm gear 73 engagement wherein the worm gear 73 is a part of a compound gear 70 comprising a gear 71 meshed with a driven gear 54 coupled through the clutch mechanism to the transmission element 60.

Due to the teeth arrangement/orientation, the motor drive shaft 51 (and motor 50) is not rotatable by rotation of the worm gear 73. The worm arrangement is thereby self-locking. In particular, the worm gear 73 would not be able to rotate the worm 52. Accordingly, the attempted manual rotation of the locking spindle (and transmission element 60) would create an immediate potential failure and problem in that this movement would be prevented unless a suitable clutch arrangement was in place. For example, a user would not be able to use either the thumb turn or key.

When the motor 50 is not powered, the worm arrangement creates a static and fixed driven gear 54 and therefore this resistance to rotation causes the clutch (acting between the transmission element 60 and the driven gear 54) to actuate to enable the transmission element 60 and the locking spindle 40 to be manually rotated by the thumb turn or key without such rotation being transmitted through to the worm arrangement.

The transmission element 60 provides a cam surface 66 to enable the position of the lock spindle 40 to be monitored and tracked, as shown in FIG. 4, FIG. 5, FIG. 11A and FIG. 11B. The Euro lock cylinder only allows the key to be inserted into the slot whilst the slot is at a predetermined single position. Similarly, the Euro lock cylinder also only allows the key to be removed at the same single predetermined position. As mentioned above, since there is a sole key insertion/removal position, the rotational position of the spindle itself does not necessarily show whether the primary lock bolt is locked or unlocked and it would only be able to show whether the key is insertable/removable or not.

Accordingly, the present invention provides a sensor system which monitors whether the lock spindle 40 was turned to the entry/removal position in a first (clockwise) direction or a second (anti-clockwise) direction which would correspond to either locking or unlocking the primary lock bolt 20. A prior art assembly comprising a lock spindle positional sensor would not be able to convey this information and would thereby enable the motor 50 to be activated to drive the lock spindle 40 to a locked position when the primary lock bolt 20 was already in the locked position. Such undesired actions may lead to a risk of failure of the lock becoming stuck in position, i.e. attempting to drive the lock bolt 20 to the locked position when it is already in the locked position.

The preferred embodiment uses switch sensors which move in and out, although alternative embodiments may use magnetic position sensors to detect the locked/unlocked position of the transmission element. These switches 42, 46 track around a circumferential periphery of the transmission element 60. These sensors will then act to stop the motor at the correct positions. As explained below, two micro switches 42, 46 sense the position of a two lobed camshaft that is attached by the splined coupling to the drive shaft of the Euro lock. The two lobed cam has an additional cam on it which engages with the two micro switches 42, 46 to sense the position of the spindle.

The lock position spindle sensor system comprises a first sensor and a second sensor. Each sensor comprises a micro switch 42, 46 with a lever arm 43, 47 having a bearing surface 44, 48. Each bearing surface 44, 48 is urged into contact with an outer tracking periphery (cam surface 66) provided on the transmission element 60. The tracking periphery 66 provides a generally circular surface with an arc 67 (cam surface) of a greater diameter. This increase in diameter is sufficient to move the lever arms 43, 47 from an open state to a closed state. Accordingly, as the tracking surface 66 rotates the micro switches 42, 46 will move between an open state and a closed state depending upon the position of the lock spindle.

As mentioned above, the position of the rotational lock spindle 40 is not sufficient to determine the state of the primary lock bolt 20. According, the present invention utilises a pair of micro switches 42, 46 which will provide sufficient information for the control system to determine whether the lock spindle 40 has been moved to the locked position or the unlocked position. In particular, the order of movement (sequence) of the two switches 42, 46 will enable the direction of movement of the lock spindle 40 to be detected which will demonstrate whether the primary lock bolt has been moved to the open (unlocked) position or to the closed (locked) position. In addition, the relative position of the micro switches 42, 46 and the cam surface 66 also enables the final position for the lock spindle 40 to be set such that the motor 50 can be stopped at the correct locked/unlocked position.

In the locked/unlocked, position both micro switches 42, 46 are in the open position. Accordingly, as mentioned above, in order to discriminate whether the lock spindle has been moved into the locked condition or the unlocked condition the direction in which the lock spindle was rotated is required. This can be discovered by the order in which the two micro switches 42, 46 were opened.

When moving to the locked position (FIG. 16) from the unlocked position (FIG. 4, FIG. 5) the sequence will be as follows:

- the first micro switch 42 will move from the open position to the closed position;
- the second micro switch 46 will move from the open position to the closed position;
- the first micro switch 42 will move from the closed position to the open position; and
- the second micro 46 switch will move from the closed position to the open position.

If the sequence is being actuated by the motor 50, the sensing of both micro switches 42, 46 being open will trigger the motor 50 to stop. The locked or unlocked condition will have been recorded by determining the sequence, e.g. which micro switch 42, 46 was opened first, i.e. first micro switch 42 opened followed by the second micro switch 46 opened or vice versa.

It will be appreciated that the manual use of the key to rotate the lock spindle will cause the transmission element to rotate further such that the key/lock spindle rotates through 360 degrees to enable the key to be removed. This will cause the transmission element to finish in the same position as the locked position shown in FIG. 4 and FIG. 5. However, the control system will still have recorded the sequence of the opening/closing of the two micro switches 42, 46 such that the system will be aware that the lock spindle is now in the locked position rather than the unlocked condition even though the lock spindle is rotationally in the same position.

The present invention is significantly different from prior art versions since the present invention can be reliably used with a Euro lock spindle which is driven through 360 degrees whereas some US style lock systems require only 90 degrees of rotation. A Euro lock key has to be rotated through 360 degrees to allow the key to be inserted and removed. The key can only be inserted and removed at a specific position. The actual rotational movement required to lock and unlock a Euro lock may actually only be 90 degrees, but the key has to be rotated a full 360 degrees from the position of insertion for it to return to its original position to allow it to be removed.

When moving to the unlocked position from the locked position the sequence will be as follows:

- the second micro switch 46 will move from the open position to the closed position;
- the first micro switch 42 will move from the open position to the closed position;
- the second micro switch 46 will move from the closed position to the open position; and the first micro switch 42 will move from the closed position to the open position.

If the sequence is being actuated by the motor 50, the sensing of the second micro switch 46 in the open position and the first micro switch 42 being opened will trigger the motor 50 to stop.

If the unlocking sequence is performed manually by the thumb turn or the external key then the unlocked condition will still have been recorded by determining the sequence, e.g. the second micro switch 46 being opened and closed before the first micro switch 42, i.e. final sequence of the second micro switch 46 opened followed by the first micro switch 42 opened.

The circumferential length of the arc 67 of the tracking periphery 66 which causes the closure of the micro switches 42, 46 has a circumferential length that allows both micro switches 42, 46 to be held in the closed condition at the same time.

During the installation process, the transmission element 60 must be engaged with the locking spindle 40 whilst the system is in the correct configuration. For example, both micro switches 42, 46 should be in the open position when the spindle engagement means is engaged with the lock spindle 40 and with the primary lock bolt 20 in the unlocked position. The increased closing arc 67 of the transmission element 60 should be just below the first micro switch 42. Accordingly, the present invention is provided in an initial installation configuration and it is intended that the present invention is then engaged with an existing locking spindle 129 for the initial set up. The present invention may provide a visual indicator to demonstrate that the mechanism is in the correct configuration for the initial set up.

The initial set up is conducted with the cam portion of the Euro cylinder lock extending directly downwards. In this orientation the Euro cylinder lock is insertable and removable from the passageway in the door into which the Euro cylinder lock locates. Accordingly, this provides a convenient predetermined orientation for the set up in which the initial configuration of the motorised door lock mechanism can be correlated with the Euro cylinder lock to which it will operate. As shown in FIG. 2A and FIG. 2B, the housing 11 includes a rear recess 26 into which the spindle engagement sleeve 30 projects. The recess 26 includes a lower arcuate surface 27 which cooperates with the lower surface of a Euro cylinder lock. Accordingly, this helps to correctly align the Euro cylinder lock and spindle with the door lock assembly 10.

The transmission element 60 interconnects with the engagement sleeve 30 that is directly secured to an exposed end of the Euro lock spindle. The engagement sleeve 30 is simply secured to the exposed stub of the Euro lock spindle using a grub screw. The splined coupling sleeve 30 is thereby secured to the drive spindle on the Euro lock using the grub screw. The length of the grub screw corresponds to the diameter of the shank of the splined coupling, so the grub screw engages in a hole 34, 35 in either side of the splined coupling to increase strength. The hole through the spindle on the Euro lock is threaded to accept the grub screw. The present invention may comprise a kit having a number of splined couplings to suit various Euro locks. The threaded hole in the Euro lock spindle is in different positions on different Euro locks. A kit may provide alternative couplings to suit these locks. In particular, the alternative couplings may have differing internal diameters (and/or differing grub screw apertures and grub screws) in order to be secured around stubs of a pre-existing locking cylinders with different outer diameters. One sleeve may have an internal diameter of 8 mm and a second alternative splined sleeve may have an internal diameter of 10 mm.

As mentioned above, during the fitting of the present invention to a door into which an existing Euro lock is installed, it is important to ensure that the position of the locking tab on the Euro lock is known (and set). The installation of the present invention has to ensure that the 'start' position for the electronic lock cycle corresponds with a corresponding 'start' position on the Euro lock. In the present invention, the splined shaft on the outer diameter of the couplings allows this. The installation instructions require the user to set the locking tab on the Euro lock to the six o clock position so that it can be inserted into the door. The present invention is dispatched with the drive cam in the correct position to correspond with the six o clock position of the Euro lock. The splines allow the coupling attached to the drive spindle on the Euro lock to mate with the splines on the drive spindle in the present invention. The splined coupling allows any Euro lock to be fitted to the present invention and ensures that the 'timing' between the Euro lock and the drive system in the present invention are synchronised.

As mentioned above, the present invention may be used with a door having a multipoint lock system 14. The multipoint lock system 14 includes a number of locking elements mounted on rails or bars which are moved into and out of engagement by the door handle 18. In particular, the door handle 18 is moved upwardly from the rest (neutral) position to move the locking elements in to the locked position. Conversely, the door handle 18 is moved downwardly from the rest (neutral) position to move the locking elements in to the unlocked position. In such a system, it is not possible to move the main locking bolt into the locked position until the locking elements have been locked. Similarly, it is not possible to move the multi point locking elements to the unlocked position until the main (primary) locking bolt 20 has been unlocked.

The present invention provides a monitoring system to detect when the multi point locking elements are locked or unlocked. This system then controls whether the motor 50 can be activated or not. The present invention requires a user to raise the door handle 18 to initiate the locking of the door which can be completed by the motorised system if required (e.g. if the user does not have a physical key). Similarly, to open the door, the motorised system can be initially actuated but the second stage must be completed by the user physically moving the door handle 18 downwardly. Accordingly, one aim of the present invention is to replace the requirement for a physical key to enable a person to gain entry or to allow a third party to authorise entry from a remote location.

As shown in FIG. 6 and FIG. 14A to 14D, the door handle 18 and multipoint configuration is monitored by a micro switch system. The present invention is arranged to monitor whether the multipoint locking elements are in the locked position (activated) or the unlocked position (deactivated). This status then controls whether the primary lock bolt can be locked or unlocked. As explained above, the primary lock bolt can only be locked once the multipoint system has been activated. Similarly, the multipoint lock system can only be deactivated once the primary lock bolt has been unlocked. Accordingly, the present invention monitors the locking status of both the primary lock bolt and the multipoint system which then controls the possible actions for the motorised actuation system.

One particular problem with a simple multipoint monitoring system occurs if the system only monitors the activation of the locking elements and then resets on the opening of the door or unlocking of the primary lock bolt. In one situation, from the fully locked configuration, a user could activate the motorised system to unlock the lock bolt which would then allow the deactivation of the multipoint system. However, if the user decided to then re-lock the primary lock bolt rather than deactivate the multipoint system then this interruption of the overall normal locking/unlocking sequence could confuse a simple/basic monitoring system. For example, if the control system only allowed the primary lock bolt to be driven immediately after the activation of the multipoint system then this would not allow for the locking of the primary lock bolt immediately after the unlocking of the primary lock bolt. Accordingly, the present invention independently monitors and correlates the two statuses of the primary lock bolt and the multipoint locking elements. In particular, the control system monitors whether the multipoint locking elements are activated or deactivated and not simply whether the last action was to activate the multipoint system.

As shown in FIG. 6 and FIG. 14A to 14D, the multi point monitoring system comprises a first micro switch 90 and a second micro switch 92 which are in communication with the control system. The closing of the first micro switch 90 will demonstrate that the multipoint system has been activated and the closing of the second micro switch 92 will demonstrate that the multi point system has been deactivated. Both micro switches 90, 92 are arranged to be held in a normally open (off) position and the switches 90, 92 are only closed temporarily by the action of raising or lowering the door handle 18.

The door handle 18 is urged to return to an intermediate position at which position neither of the micro switches 90, 92 are closed. Accordingly, the control system monitors the last micro switch 90, 92 to be in the closed position such that this will indicate whether the multi point locking elements are in the locked position or the unlocked position.

As in conventional door arrangements, the door handle 18 is mounted on a rotating spindle which will move the locking rails/bars for the multi point system. The present invention provides a tracking member in the form of a collar 94 secured around and fixed to rotate with the handle spindle. This collar 94 comprises an outer peripheral surface 95 providing a cam surface to engage with bearing surfaces on the micro switch levers 91, 93. The cam surface 95 effectively provides two lobes 96, 97 which will independently urge the levers 91, 93 downwardly as the collar 94 is rotated. The outer diameter of the collar 94 gradually increases for these lobe portions 96, 97 and conversely the outer diameter of the collar 94 gradually decreases as the diameter returns from the lobe portions 96, 97 to the rest position.

As the door handle 18 is rotated, the collar 94 will rotate and therefore the peripheral surface 95 will move relative to the ends of the levers 91, 93. As the door handle 18 rotates from the rest position to the raised position the collar 94 rotates and the first lobe portion 96 will urge the first lever 91 downwardly. This downward movement will thereby close the first micro switch 90.

Figure 14D:
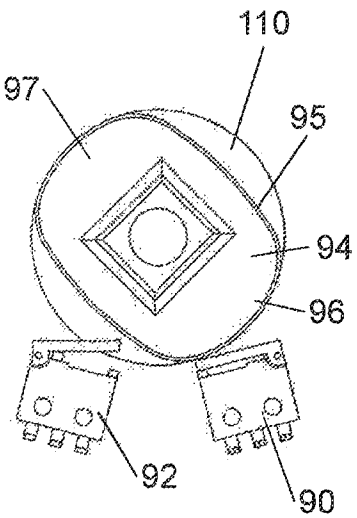
FIG. 14D is a rear view of at least a part of a multi point locking mechanism monitoring system of a preferred embodiment of a motorised door lock assembly in the configuration shown in FIG. 1A.
Figure 14B:
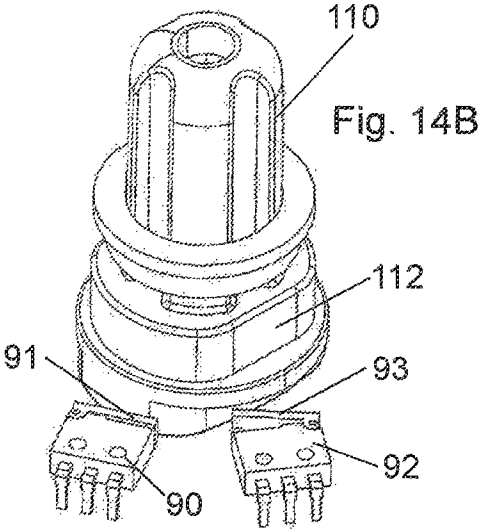
FIG. 14B is a front perspective view of at least a part of a multi point locking mechanism monitoring system of a preferred embodiment of a motorised door lock assembly in the configuration shown in FIG. 1A.
Figure 14C:
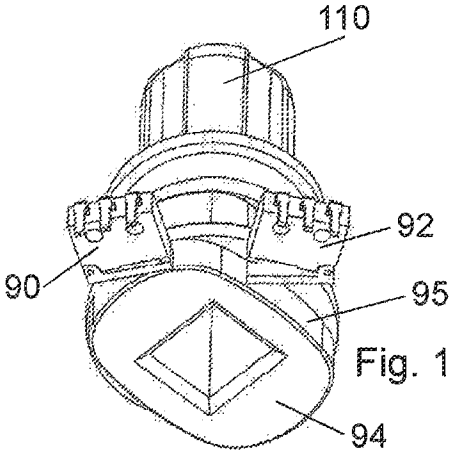
FIG. 14C is a rear perspective view of at least a part of a multi point locking mechanism monitoring system of a preferred embodiment of a motorised door lock assembly in the configuration shown in FIG. 1A.
Figure 14A:
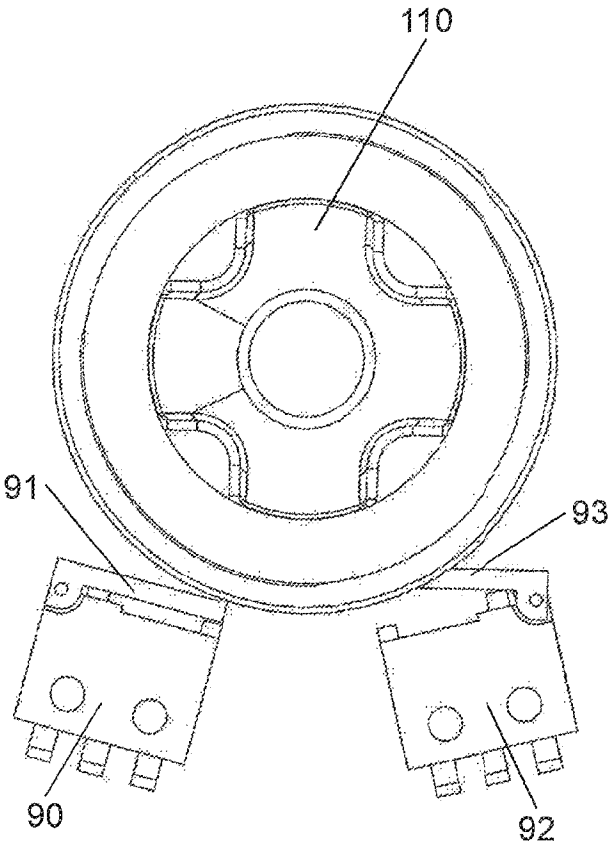
FIG. 14A is a front view of at least a part of a multi point locking mechanism monitoring system of a preferred embodiment of a motorised door lock assembly in the configuration shown in FIG. 1A.

The door handle assembly 10 comprises a return mechanism to urge the door handle 18 back to the rest position. This mechanism comprises two opposing blocks 114, 115 which are urged together and between which a biasing collar 112 of the door handle 18 rotates, as shown in FIG. 3 and FIG. 14B. The biasing collar 112 is provided on the handle retaining boss 110 on which the collar 94 is also provided. In the preferred embodiment, this comprises a single integrated component 110. Again, this biasing collar 112 is shaped to urge the door handle 18 to return to the rest position. In the preferred embodiment, the biasing collar 112 has an outer periphery in the form of an oval collar or disc. The opposing blocks 114, 115 are urged relatively towards each other through the use of compression springs 116.

Accordingly, after a user has moved the door handle 18 upwardly to activate the multi point system the user will release the door handle 18 such that the door handle returns to the rest position. This movement sequence will cause the first micro switch 90 to close and then re-open but the control system will be aware that the multi point system has been activated. The control system will thereby allow and permit the locking of the lock bolt.

With the primary lock bolt unlocked, if the user moves the door handle 18 downwardly then this will cause the second micro switch 92 to close. On release of the door handle 18, the door handle 18 will return to the rest position which will re-open the second micro switch 92. However, the control system will record that the multi point locking system is deactivated. With this recorded status, the control system will not allow the lock bolt to be moved by the motor 50. Specifically, the control system will not enable the motor 50 to drive the lock bolt forwards into the locked position.

In the present invention, the motor 50 is not operational until the handle 18 has been raised. This is achieved through the sensors which are located to detect the movement of the handle 18 which then allows the motor 50 to become operational. The door handle 18 has a pair of symmetrically opposing cams 96, 97 attached to its rear surface. When the handle 18 is raised one of the cams 96 actuates a micro switch 90 which confirms that the handle 18 has been raised and the multi point locking system engaged. The locking cycle then begins automatically. The present invention also has a second micro switch 92 which is activated by a second cam 97 attached to the door handle, at 180 degrees from the first cam 96. This switch 92 can detect when the door handle 18 has been depressed to open the door. The reason for this second switch 92 is to address a situation in which a user unlocks the door from a phone, push button, keypad or key fob, does not try to open the door, but then immediately decides to re-lock it without touching the door handle 18. The system has to know that the handle 18 has not been moved, before re-locking the door, to prevent a situation occurring in which the user attempts to electronically lock the door when the handle 18 has not been raised and the multi point locks engaged or the handle 18 has been depressed to open the door.

Overall, the control system regulates the possible actions through the continual monitoring of the statuses of both the primary lock bolt and the multi point locking system. Specifically, the control system only enables the primary lock bolt to be moved to the locked position or unlocked when the multi point locking elements have been activated and in the locked position. Similarly, the control system only allows the primary lock bolt to be driven forwards when the lock bolt is in the unlocked position and only allows the primary lock bolt to be driven in the reverse direction when the primary lock bolt is in the locked position.

As shown in FIGS. 1A to 1D and FIG. 3, the door assembly lock assembly 10 also provides an internal push button 28 which can be used to activate the motorised system. In particular, the push button 28 can be used to unlock the lock bolt from the inside without having to use the thumb turn or another activator, e.g. key fob, smart phone etc.

In addition, the movement of the handle 18 upwardly may automatically activate the motorised system to lock the lock bolt. This may help to prevent the door becoming solely locked by the multi point system (and therefore easily openable from outside) but not being locked by the main lock bolt and therefore preventing the easy unlocking of the door from the outside.

Since the primary lock bolt can be moved by either the thumb turn 22 or by the key or by the motor 50 the control system must be able to monitor the status of the lock bolt independently of the status of the last action of any one of these methods. One problem addressed by the present invention is the inability of the thumb turn 22 or key to move the motor 50 in the reverse direction. This is not possible due to the use of the worm arrangement which keeps the assembly very compact and provides an aesthetic appearance. If the motor 50 could be reversed and each of the methods had components which were all effectively fixed to communally rotate then the tracking of the status would be more straightforward. However, the use of a worm 52 prevents the motor 50 being manually rotated in reverse and also Euro cylinder locks have an internal mechanism which means that the thumb turn 22 (and motor 50 in the present invention) does not rotate the external key slot. Furthermore, the Euro cylinder lock has a single set position at which the key can be inserted/removed and this is fixed to be the same position whether the key is being used to move from the locked position to the unlocked position or from the unlocked position to the locked position. The present invention aims to solve all of these aforementioned problems.

In operation, a user has a remote unit which is wirelessly connected to the motorised door lock unit 10 mounted on the door. The user can then select to unlock the door and this signal is transmitted to the control system. The control system will know whether the multipoint lock system 14 is locked and whether the lock bolt is locked. If the lock bolt is locked (see position shown in FIG. 1B and FIG. 15), the multi point lock must also be locked, then a signal will be communicated to the motor 50 to activate in the reverse direction. The motor 50 will operate and this movement will be transmitted through the gear arrangement to withdraw the lock bolt. The first and second micro switches 42, 46 will initially move from the open position to the closed position. During the further movement, the second micro switch 46 will open and the first micro switch 42 will then subsequently open which will indicate that the motor 50 can be stopped (see position shown in FIG. 1C and FIG. 16). A user can then press down and lower the door handle 18 (see position shown in FIG. 1D and FIG. 17) to release the locking elements of the multi point locking system 14 and open the door. Both micro switches 42, 46 are arranged to be held in a normally open (off) position and the switches 42, 46 may only be closed temporarily by the action of extending and retracting the lock bolt.

In order to lock the door, again, a user can activate this from the remote unit and this signal is remotely transmitted to the control system. The control system will know the locking statuses of the lock bolt and the multipoint lock system. In order to lock the primary lock bolt, the multipoint system must first have been actuated by a user raising the door handle 18 (see FIG. 1A and FIG. 4). If this has not been actuated then the lock bolt cannot be moved to the locked position and a signal will be communicated back to the user. As mentioned above, a user may simply raise the handle 18 which may initially engage the multi point elements and then subsequently trigger the motor to operate in order to lock the main lock bolt.

If the multipoint lock system 14 is actuated, then the control system powers the motor 50 to drive in the forward direction. This movement is transmitted through the gear mechanism and moves the primary lock bolt into the locking recess in the door frame. The first and second micro switches 42, 46 will both move from the open position to the closed position. During this movement, the first micro switch 42 will open and the second micro switch 46 will then open which will indicate to the control unit that the motor 50 can be stopped (see position shown in FIG. 1B and FIG. 15).

A user will be able to monitor the status of the lock using the remote unit which is preferably a smart phone.

The smart phone (or other remote unit) may transmit the signals using the internet such that the signals may be generated from anywhere. Alternatively or additionally, the control system may have direct communication with the remote unit and this may be provided by a Bluetooth signal or radio signal. The top part of the housing may be RF transparent.

Internally the motorised system may be controlled by the push button 28, a smart phone, key fob, key pad other similar device. Externally, the motorised system may be controlled by a smart phone, key fob, keypad or other similar device. Such devices may have varying levels of identification and may use fingerprints, iris recognition, face recognition etc. The system may enable a smart phone to set a temporary code which could then be used to allow a person to operate the door lock although this code may not be reusable (or time limited to provide a level of security whilst still enabling the door lock to be operated by a delivery person for example. The main lock bolt may also be automatically activated by raising the handle 18 and this automation feature may be turned on or off.

The control unit may be integrated into a home automation system in which multiple sensors control and monitor many different functions, for example lighting, heating, security, audio etc. The system may have a hub with which the smart phone connects and the hub then transmits the signal to the door lock unit 10 with which it is in communication. Such a home system may incorporate several door lock units 10 with a user having a menu screen to enable the status of all of the doors to be monitored with the ability to lock/unlock each door.

In an alternative embodiment, the upper door handle position sensing system may utilise pins to control remote micro switches 90, 92 in a similar way to that described above. The collar 94 comprises an outer peripheral surface 95 providing a cam surface to engage with an upper end of a first pin and a second pin. The cam surface effectively provides two lobes which will independently urge the pins downwardly as the collar 94 is rotated. The outer diameter of the collar 94 gradually increases for these lobe portions 96, 97 and conversely the outer diameter of the collar 94 gradually decreases as the diameter returns from the lobe portions 96, 97 to the rest position.

The pins include urging members in the form of compression springs which urge the upper ends of the pins into engagement with the peripheral (tracking/bearing) surface 95 of the collar 94. The upper end of each pin comprises a bearing surface which is arranged to smoothly track around the peripheral surface 95. As the door handle 18 is rotated the collar 94 will rotate and therefore the peripheral surface 95 will move relative to the ends of the pins. As the door handle 18 rotates from the rest position to the raised position the collar 94 rotates and the first lobe portion 96 will urge the first pin downwardly.

The lower end of the first pin is in engagement with an actuator portion which ensures a good contact is made with the lever element 91 of the first micro switch 90. This downward movement will thereby close the first micro switch 90. Similarly, the lower end of the second pin is in engagement with an actuator portion which ensures a good contact is made with the lever element 93 of the second micro switch 92. This downward movement will thereby close the second micro switch 92.

As a summary of the preferred embodiment, shown in FIGS. 1A to 1D, the door frame would be to the left of the electronic lock unit/door lock assembly and when locked, the deadlock on the 4 point locking system (multipoint locking system) moves to the left to engage into the door frame.

Figure 5:
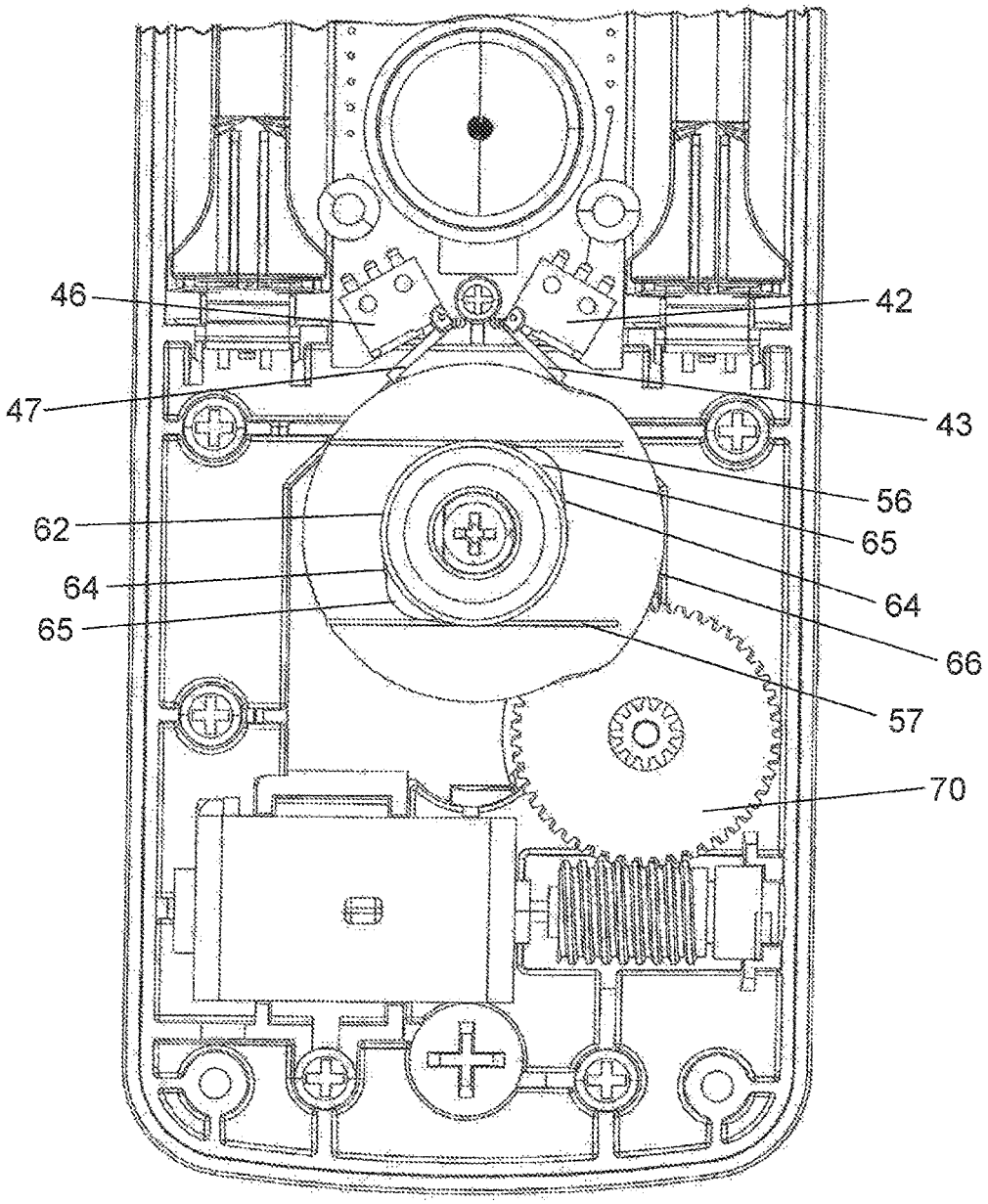
FIG. 5 is a partial front view of a preferred embodiment of a motorised door lock assembly in the configuration shown in FIG. 1A.
Figure 6:
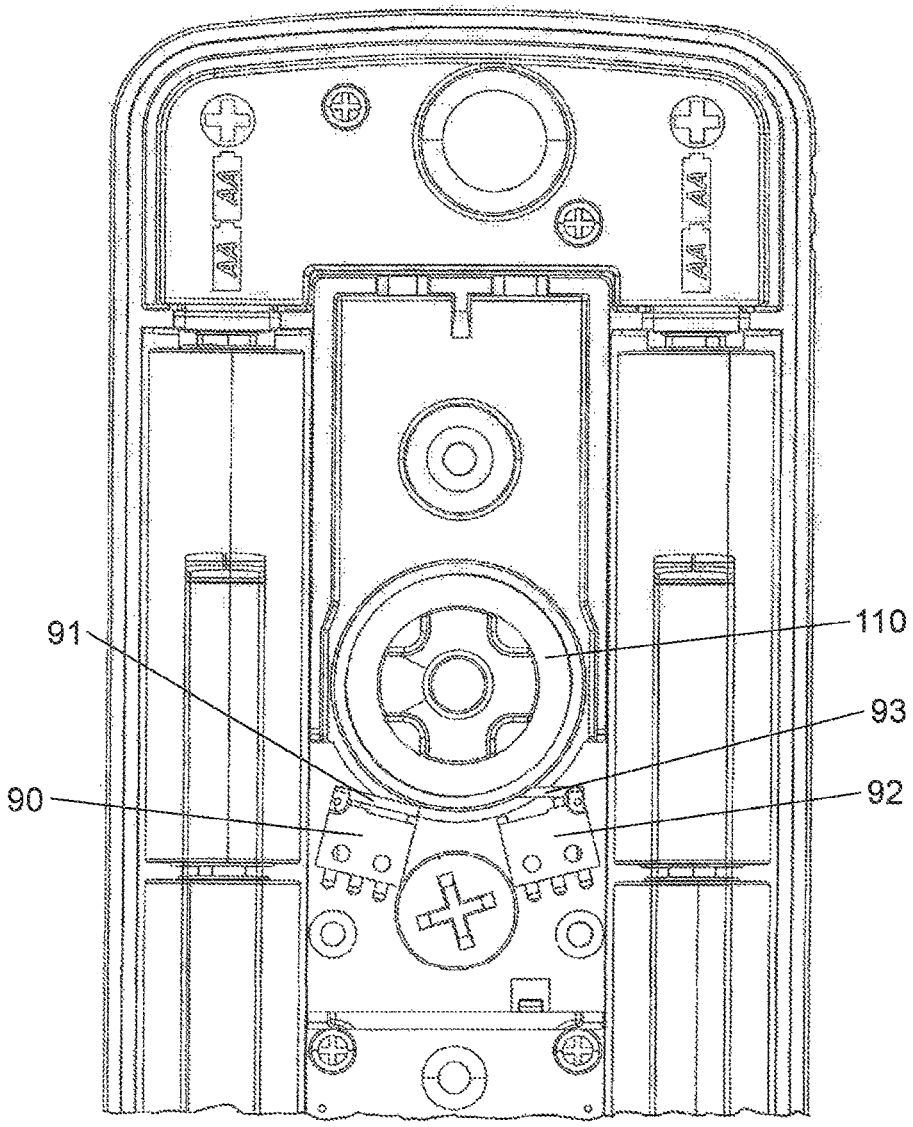
FIG. 6 is a partial front view of a preferred embodiment of a motorised door lock assembly in the configuration shown in FIG. 1A.
Figure 8:
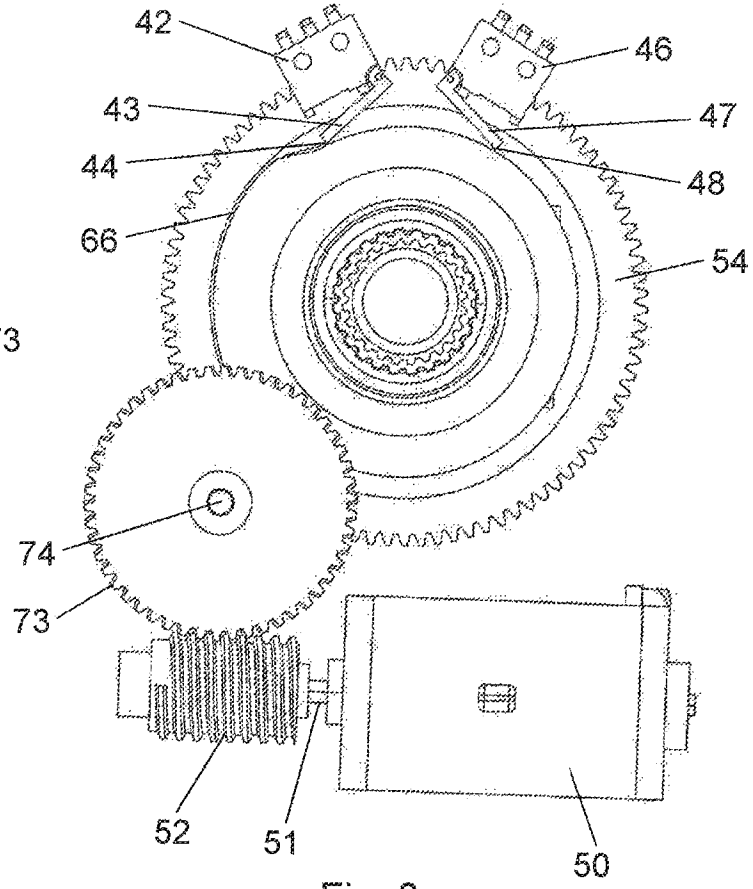
FIG. 8 is a rear view of at least a part of a gear mechanism of a preferred embodiment of a motorised door lock assembly in the configuration shown in FIG. 1A.
Figure 7:
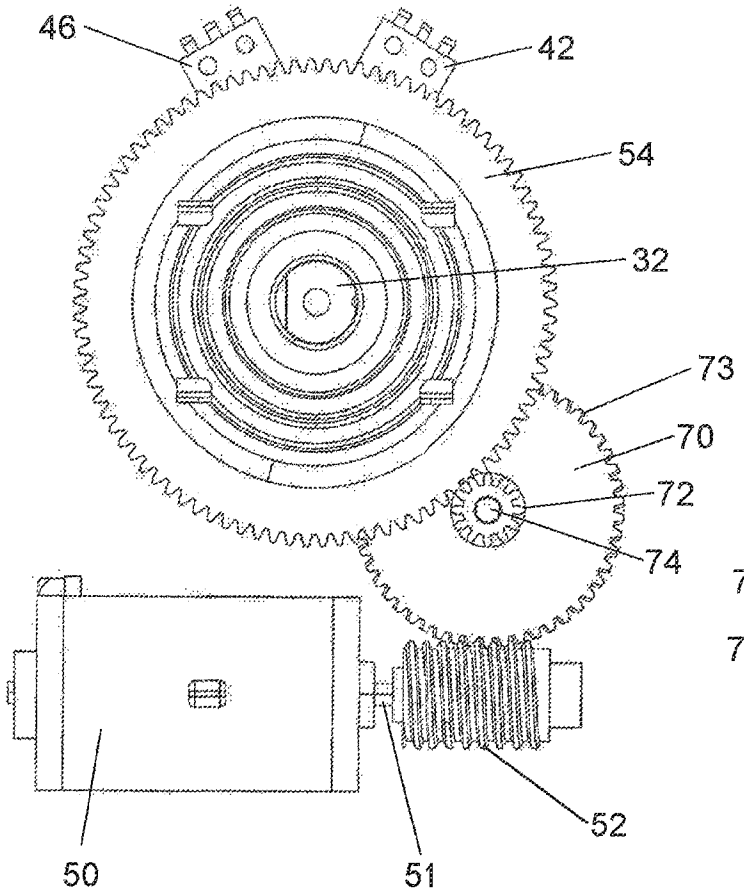
FIG. 7 is a front view of at least a part of a gear mechanism of a preferred embodiment of a motorised door lock assembly in the configuration shown in FIG. 1A.
Figure 10:
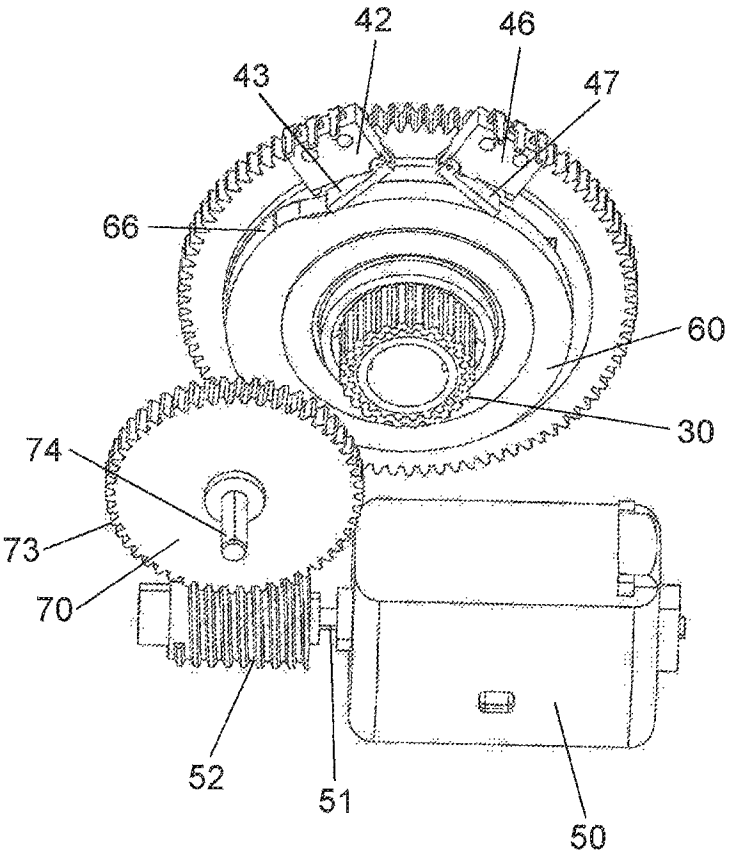
FIG. 10 is a rear perspective view of at least a part of a gear mechanism of a preferred embodiment of a motorised door lock assembly in the configuration shown in FIG. 1A.
Figure 9:
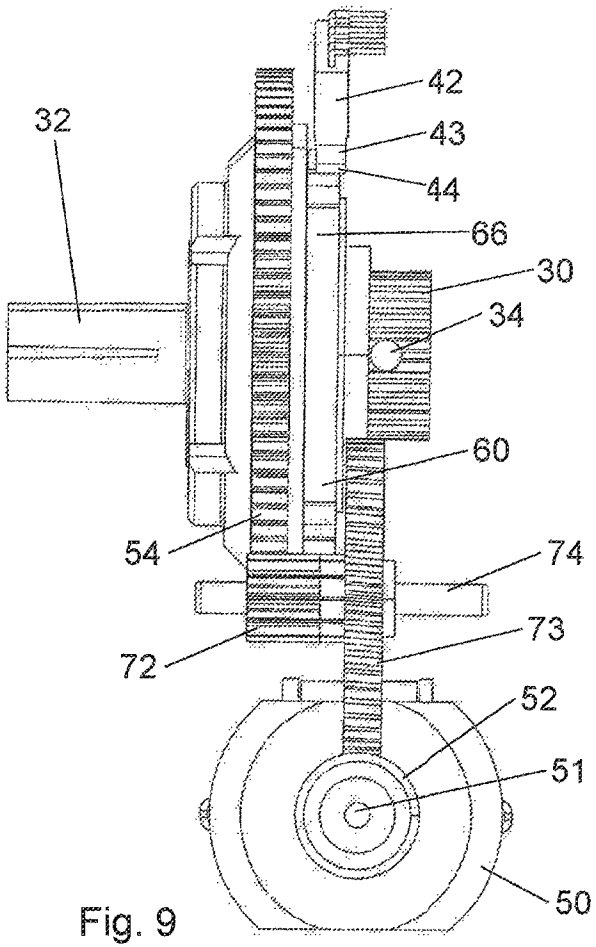

In FIG. 1A, the lock is unlocked. From this position, the geared door locking mechanism rotates anti clockwise to lock the door. The handle 18 is shown in the raised position, which initiates the auto lock feature. The lobe 96 on the handle locking cam 94 (see FIG. 14D) has rotated downwards, as the handle 18 is raised, and this lobe 96 has depressed the left hand handle micro switch 90 to initiate the auto lock feature which activates the motor 50. As shown in FIG. 5, the cam 66 on the transmission element 60 is in the right hand position and both micro switches 42, 46 are not in contact with the raised lobe 67 on the cam 66. When the lock cycle is initiated, the transmission element/gear 60 and cam 66 will rotate anti clockwise to the lock the door. Also shown in FIG. 1A, FIG. 4 and FIG. 6, the handle 18 is in a raised position and the handle cam 94 is depressing the handle micro switch 90 and the motor 50 is then activated which rotates the gear/cam 60 and Euro lock spindle anti clockwise to lock the door.

Figure 15:
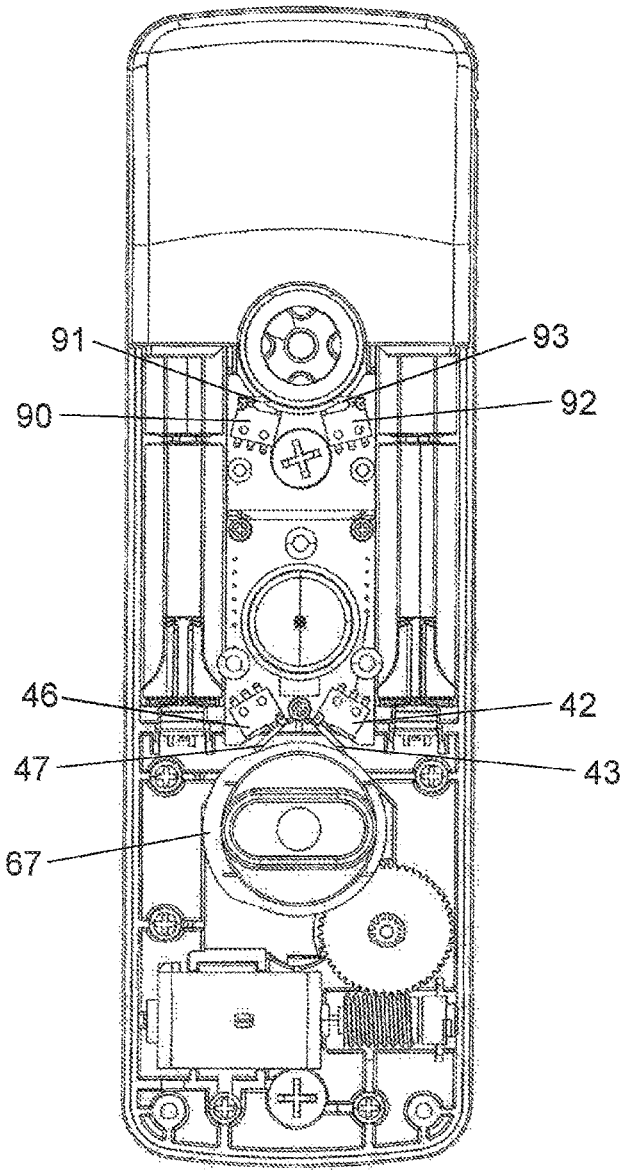
FIG. 15 is a partial front view of a preferred embodiment of a motorised door lock assembly in the configuration shown in FIG. 1B.

In FIG. 1B and FIG. 15, the lock is now locked. The handle 18 is in the horizontal position. The gear/cam/Euro lock spindle are in the anti-clockwise locked position. Neither handle micro switches 90, 92 are activated.

Figure 16:
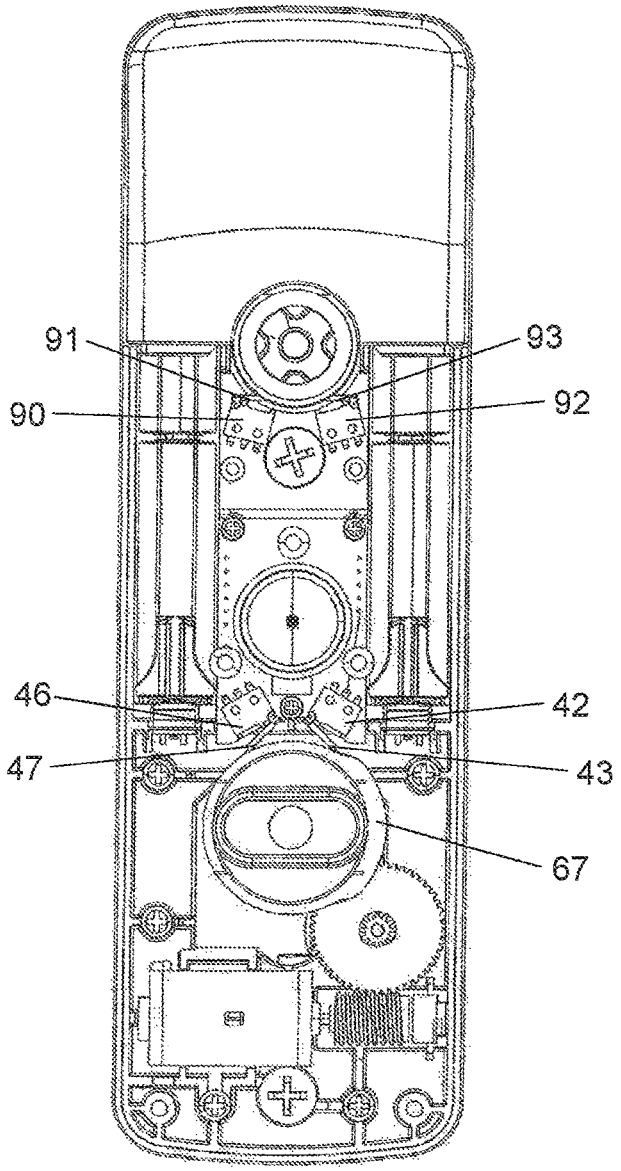
FIG. 16 is a partial front view of a preferred embodiment of a motorised door lock assembly in the configuration shown in FIG. 1C.

From the locked position the user can enter a four digit code on the keypad or press the unlock button on the key fob or use the APP on a mobile or press the unlock button 28 on the lock unit to unlock the door. The motor 50 will be energised and the gear/cam/Euro lock will rotate clockwise to unlock the door. The gear/cam micro switches 42, 46 will detect the position of the gear/cam and stop the motor 50 when the cam has released the right hand micro switch 42. FIG. 1C and FIG. 16 shows this configuration and demonstrate that the gear/cam/Eurolock spindle is in the clockwise-unlocked position. Neither handle micro switches 90, 92 are activated.

With automatic motorised door locks, there is a potential condition when unlocking the door that needed to be solved by the present invention. For example, commencing in the situation when the door is locked and the user decides to unlock the door using the keypad, key fob, APP or push-button 28. The motor 50 drives the lock to the unlocked position. However, before touching the door handle, the user decides to re-lock the door. The control system needs to determine therefore that, before the door is relocked, the user has not pressed the handle downwards and disengaged the 4-point locking system. The present invention achieves this by monitoring the state of the two handle micro switches 90, 92. If, after electronically unlocking the door, the system does not detect that the handle micro switch 92 has been activated, then it knows that the 4-point locking system has not been disengaged, and will allow the door to be re-locked. If, after unlocking the door, the system does detect that the handle micro switch 92 has been activated, then it knows that the 4-point locking system has been disengaged and it will not allow the door to be re-locked.

The micro switches effectively operate as logic gates to enable the combination of configurations of the handle/multi point lock and the Eurocylinder spindle/lock bolt to be continually recorded at all times.

Figure 17:
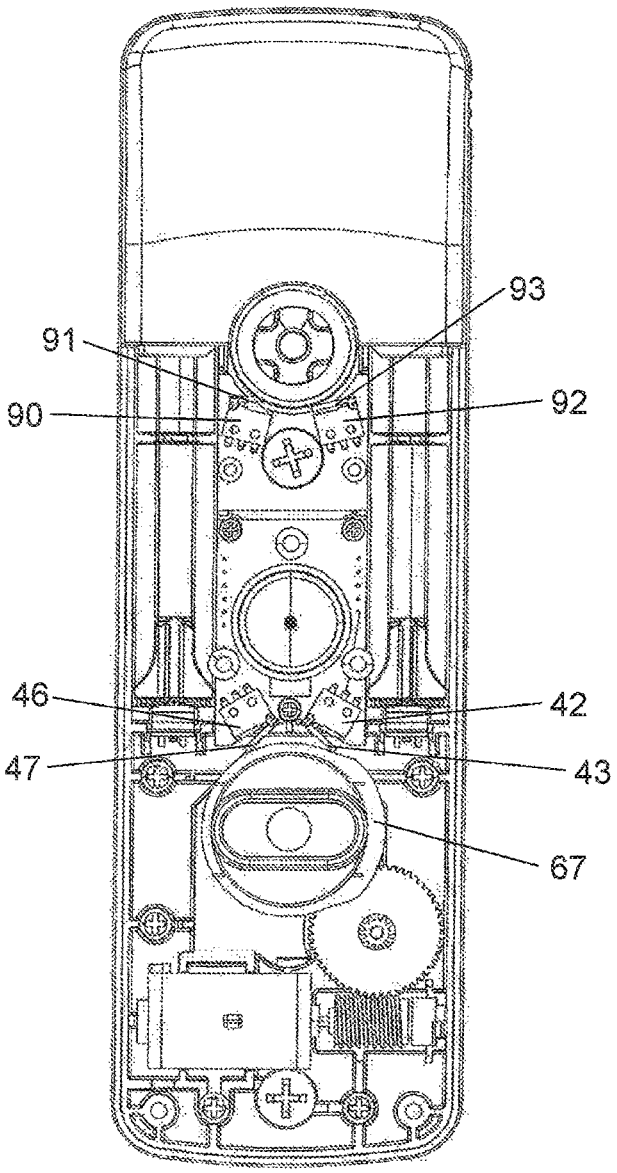
FIG. 17 is a partial front view of a preferred embodiment of a motorised door lock assembly in the configuration shown in FIG. 1D.

FIG. 1D and FIG. 17 show a situation in which the door has been electronically unlocked and the user has pressed the handle downwards to unlock the 4-point locking system. The right hand handle micro switch 92 has been depressed when the handle 18 is pushed downwards and so the system knows that the 4-point locking system has been disengaged. If the user tries to re-lock the door without raising the handle 18 (to the auto lock position), then the system will not allow the motor 50 to be activated which would otherwise attempt to try and re-lock the lock bolt.

Figure 18C:
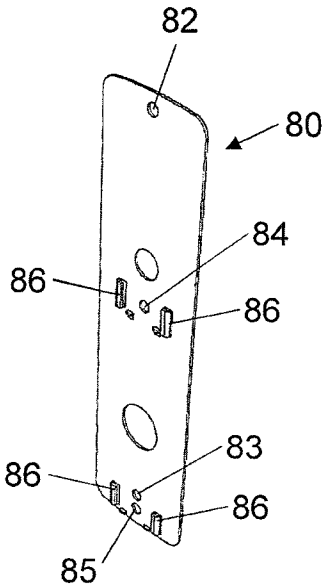
FIG. 18A to 18C are front, side and front perspective views of a preferred embodiment of a mounting plate for a preferred embodiment of a door lock assembly.
Figure 18B:
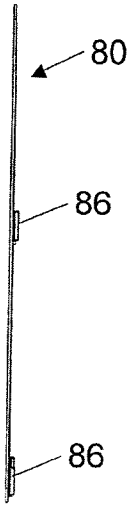
Figure 18A:
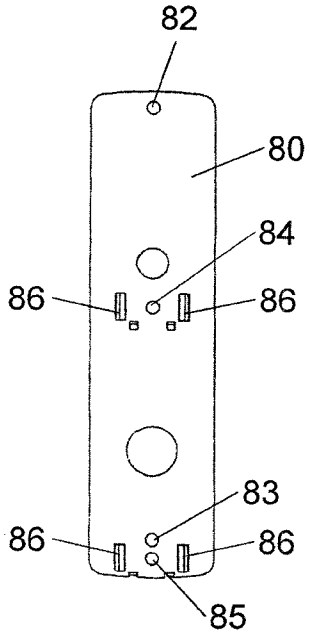

As described above, the present invention provides an assembly for converting an existing door lock to a motorised door lock. To achieve this aim and to enable the present invention to be used with multiple existing door locks, the present invention may utilise a mounting plate 80 to enable the same door look assembly 10 to be installed on pre-existing door locks with a variety of dimensions. In particular, an escutcheon/back plate used with some Euro cylinder locks and 4-point locking system may have two different sizes which can be generally referred to as a short back plate or a long back plate. The short back plate may have two fixing holes which are spaced apart by 122 mm whereas the long back plate may have two fixing holes which are spaced apart by 210 mm. In order for the present invention to be suitable for both back plates (as well as further spacing dimensions) the present invention uses a mounting plate 80, as shown in FIG. 18A to FIG. 18C. The mounting plate 80 has fixing holes for fixing the door lock assembly 10 to the mounting plate 80. This single mounting plate 80 provides fixing holes which enable it to be secured to the existing securement holes/bores on the door which may be spaced apart by 122 mm or 210 mm. Accordingly, the present invention provides a single door lock assembly 10 which can be quickly and easily fitted to the existing securement components provided with existing door locks.

The present invention thereby provides a single housing 11 and door lock assembly 10 which accommodates shorter and longer versions of the escutcheons used with some Euro cylinders and 4-point locking systems.

As shown in FIG. 18A to FIG. 18C, the assembly 10 includes a mounting plate 80 which enables the door lock assembly 10 to be installed on the pre-existing door hardware. As mentioned above, the pre-existing door hardware generally provides two mounting screws which are spaced apart either by a first separation distance or a second separation distance. The standard distance between the Euro cylinder lock (locking spindle) and the handle spindle are the same in both versions so a single door lock assembly 10 can be used with both and the different screw spacing is accommodated. The present invention provides a mounting plate 80 which enables the door lock assembly 10 to be secured with the pre-existing mounting points of either version.

In particular, the mounting plate 80 is arranged to be secured to the housing at two locations which coincide with the locations for mounting the door lock assembly to the short back plate. Accordingly, two securement screws are simply used to pass through the door lock assembly 10 and the securement apertures 84, 85 of the mounting plate 80 and into the existing securement bores provided in the door. However, if the door lock assembly is to be secured to the existing bores of a long back plate then the mounting plate 80 is initially secured using two shorter screws though the apertures 82, 83 and into the existing securement bores provided by the door. The housing 11 can then be secured to this mounting plate 80 using two shorter screws which extend from the front of the housing 11 to the mounting plate 80 which provides two threaded holes 84, 85. Since they are offset and due to the shortened length, these shorter screws will then not penetrate the door. The mounting plate 80 is concealed in a recessed area on the back of the housing and may be secured to the rear of the housing using cooperating flanges 86.

The long back plate may have one pair of fixing holes at either end of the escutcheon that are 210 mm apart whereas the short back plate may have one fixing hole at the bottom and one just beneath the handle which are 122 mm apart. One aim of the present invention is to provide a single door lock assembly which can be retrospectively fitted to a variety of existing (external mechanisms of) door locks.

The proposed solution is that the length of the housing accommodates the longest escutcheon. Accordingly, the total length of the housing is 245 mm whereas just for the short version a length of 220 mm would have been sufficient. The distance between the handle centre and the Euro lock centre is generally the same for both versions.

The present invention required a means to accommodate the variation in position of the lower fixing, and a means to accommodate the top fixing on the long back plate version and the fixing below the handle on the short back plate version. The solution results in a lengthened version of the housing 11 which extends upwards above the handle. The visible screws passing through the front cover of the present invention are offset from the actual door fixing screws since these door-fixing screws would penetrate the mechanism of the present invention. A mounting plate 11 thereby acts as an adaptor to convert the lock fixings to those on the standard product to those that require different centres. For use with longer versions of the front escutcheon, the adaptor plate 11 will be fitted to the inside of the door. Bolts will pass through this to secure it to the escutcheon and door handle assembly mounted to the front of the door. This metal mounting plate will have additional threaded holes in it, the positions of which will correspond to the holes in the motorised door lock assembly. The motorised door lock assembly 10 is offered onto the metal plate (mounting plate 80) and bolted to it using short bolts that will extend through the door lock assembly 10 into the metal mounting plate 80. The metal mounting plate 80 is concealed in a recess in the back of the housing 11 of the motorised door lock assembly 10.

The present invention maintains the external handle and the motorised lock assembly is directly secured to a component of an existing Eurocylinder (i.e. either the internal thumb turn of spindle of the thumb turn). This enables just the inner part to be supplied and uses any existing (and any make of) Eurocylinder (with a thumb turn).

As described above, the user must engage the multi point locking system 14 manually before the deadbolt 20 can be activated. This guarantees that the deadbolt 20 and deadbolt receiving aperture are aligned before the deadbolt 20 is actuated.

Figure 20:
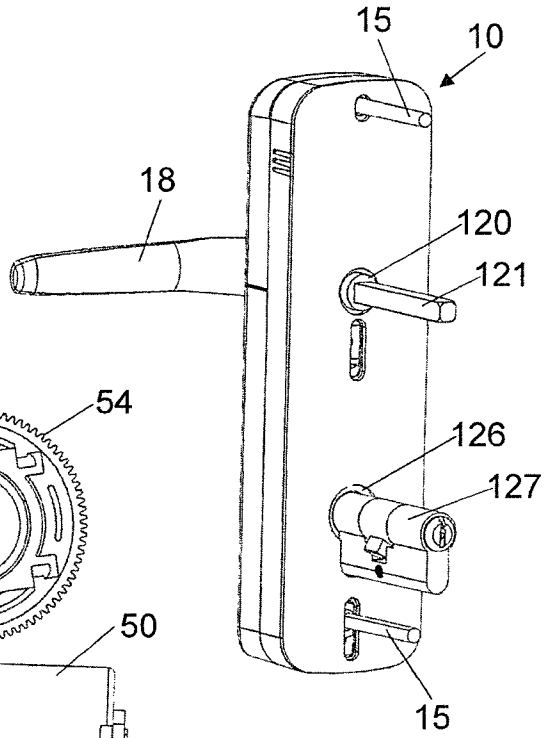
FIG. 20 is a rear perspective view of another embodiment of a motorised door lock assembly.
Figure 24:
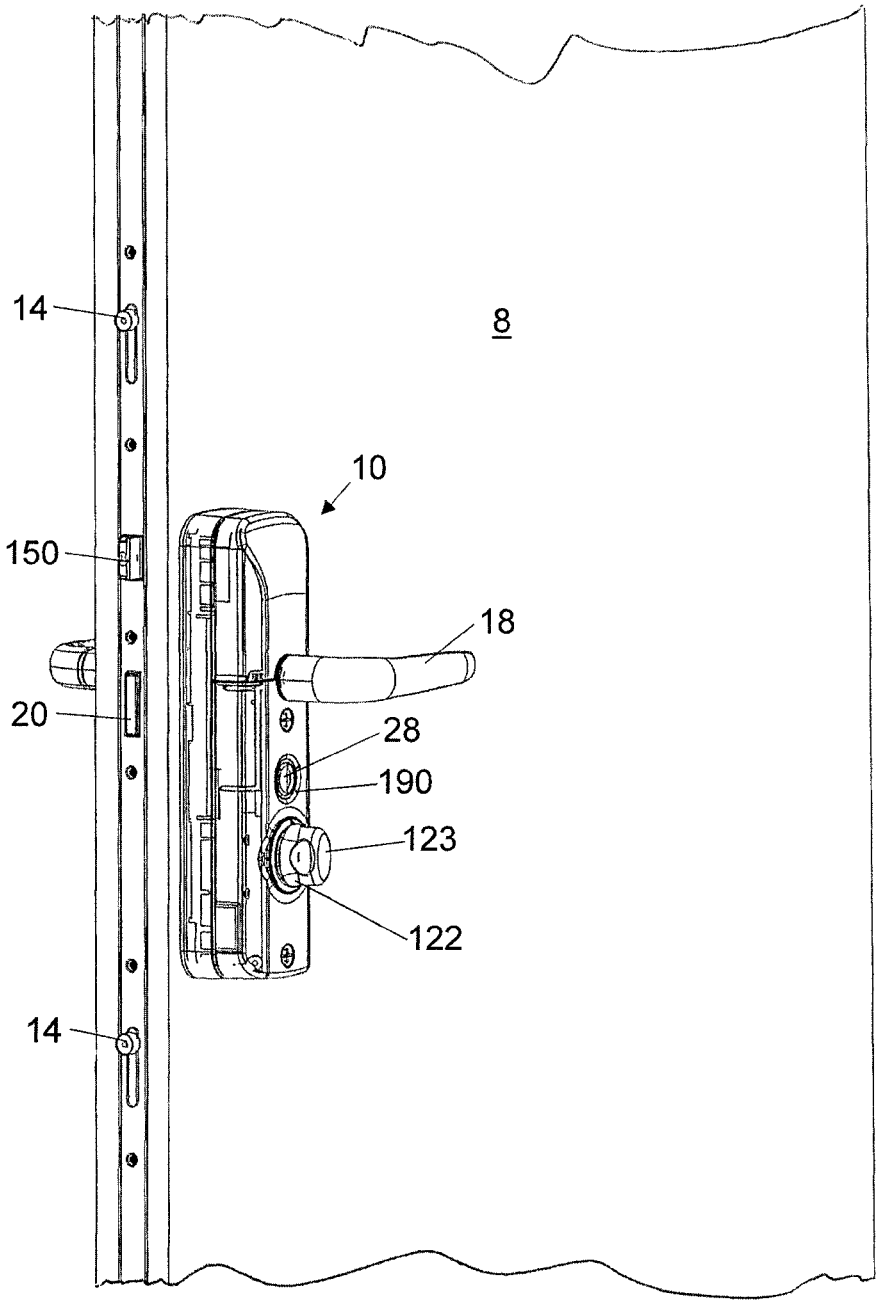
FIG. 24 is a perspective view of another embodiment of a motorised lock assembly mounted to a door.

As shown in FIG. 20 and FIG. 24, the motorised door lock 10 is screwed to a metal mounting plate 80 that is fixed to the door 8 before the motorised door lock is fitted. The mounting plate 80 may or may not have a rubber gasket placed between the mounting plate 80 and the door 8 to reduce noise.

Figure 22:
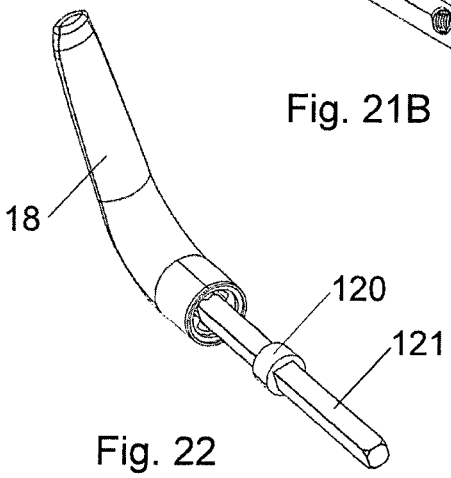
FIG. 22 is a perspective view of a handle with an alignment spacer located on a handle spindle of another embodiment of a motorised lock assembly.
Figure 23:
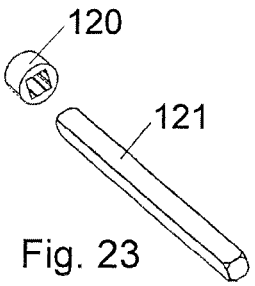
FIG. 23 is an exploded perspective view of an alignment spacer and a handle spindle of another embodiment of a motorised lock assembly.

Before the mounting plate 80 is fitted to the door 8, an injection moulded alignment spacer 120 is fitted over the handle spindle 121, as shown in FIG. 22 and FIG. 23. The alignment spacer 120 has a square hole (aperture) defined therethrough that allows the alignment spacer 120 to slide along the shaft of the handle spindle 121. The alignment spacer 120 is pushed onto the shaft until one end fits into the circular hole drilled in the door and the other end protrudes from the door 8 enough to locate into a corresponding hole in the metal mounting plate 80.

As shown in FIG. 20, the housing 11 includes a rear recess 126 for cooperating with the end of the Euro cylinder lock 127. The recess 126 provides a perimeter surface which cooperates with the outer surface of a Euro cylinder lock 127. Accordingly, this helps to correctly align the Euro cylinder lock 127 and spindle with the door lock assembly 10.

Figure 21A:
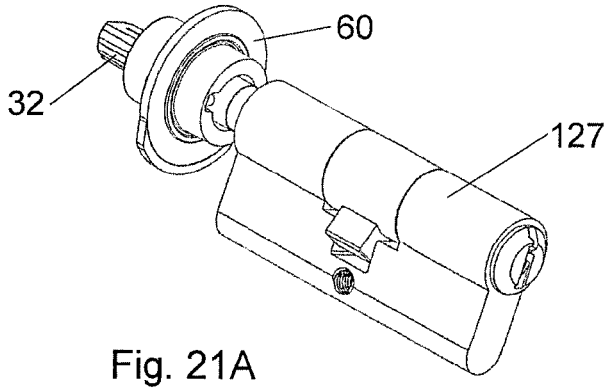
FIG. 21A is a perspective view of a Euro cylinder engaged within a transmission element of another embodiment of a motorised lock assembly.
Figure 21B:
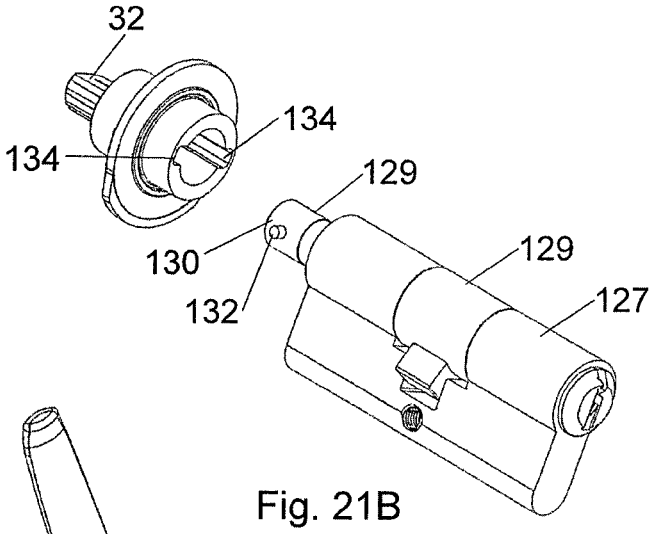
FIG. 21B is an exploded perspective view of a Euro cylinder and a transmission element of another embodiment of a motorised lock assembly.

As shown in FIG. 21A and FIG. 21B, another embodiment of the present invention utilises an alternative rotary locking spindle engagement means. In particular, this embodiment does not use a splined sleeve but uses a roll pin 132 that passes right through the cylindrical lock spindle 129 that projects out of the end of the Eurocylinder 127. The cylindrical end 130 of the Eurocylinder spindle 129 engages into a corresponding cylindrical hole 61 in the centre of the transmission element 60/clutch moulding. The two projecting ends of the roll pin 132 engage into two slots 134 that extend radially out of the cylindrical hole 61 in the transmission element 60/clutch moulding. The fit between the cylindrical shaft 129 and extending ends of the roll pin 132 into the corresponding features on the transmission element 60/clutch moulding is sufficiently loose to accommodate any misalignment between the Eurocylinder 127 and the electronic door lock 10 that may occur during assembly.

Figure 19B:
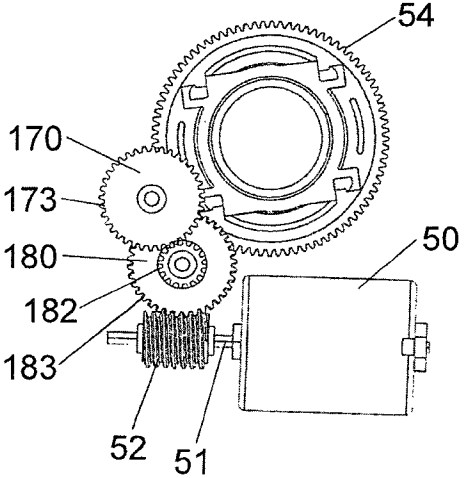
FIG. 19B is a rear view of at least part of a gear mechanism of another embodiment of a motorised door lock assembly.
Figure 19A:
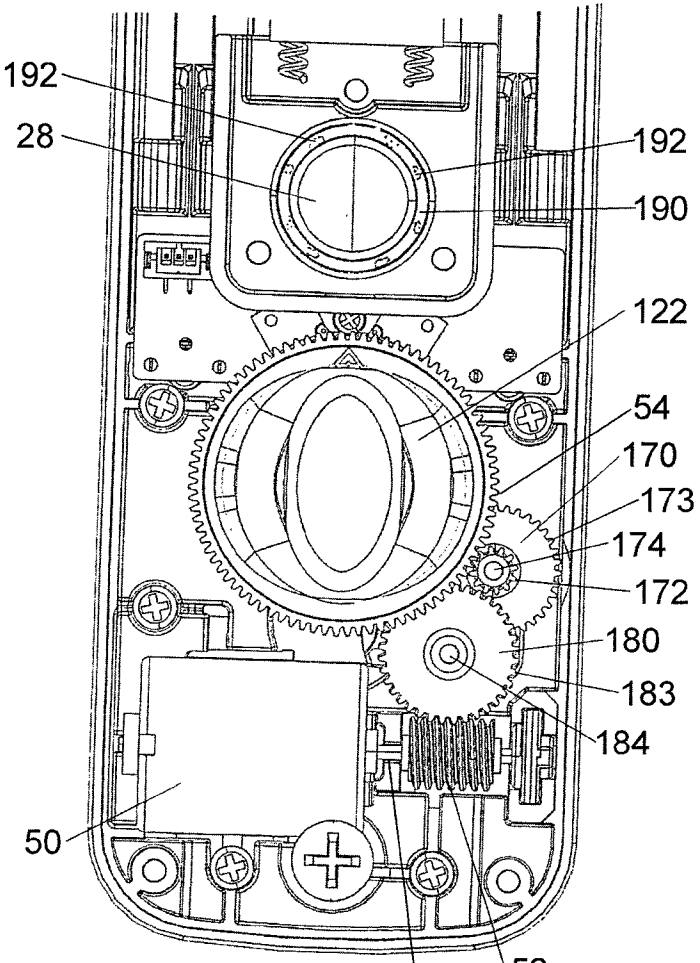
FIG. 19A is partial front view of another embodiment of a motorised door lock assembly.

Embodiments of the present invention may have different gear trains/gear boxes and, in particular, another embodiment of the present invention includes two intermediary gears, as shown in FIG. 19A and FIG. 19B.

This gearbox has an additional set of gears compared to the earlier described embodiment of the present invention. The added set of gears alters the gear ratio and delivers increased drive torque to the Eurocylinder.

Specifically, the drive mechanism (shown in FIG. 19A and FIG. 19B) provides an arrangement of the motorised mechanism comprising a worm 52 which prevents the system from being back driven. The motor 50 cannot be rotated by rotating the main drive wheel 54 (the drive gear 54 cannot be back driven). However as explained above, the clutch allows the user to rotate the key (or thumb turn) in either direction, even if the gearwheel/worm drive is jammed.

The outer circumference of the driven gear 54 is meshed with a first intermediary gear 170. In particular, the first intermediary gear 170 is a compound gear member 170. The compound gear member 170 provides a stepped gear mechanism (or double gear) whereby the gear ratio is selected to increase the rotational speed by a required amount.

The compound gear 170 provides a first smaller gear 172 which engages with the gear 54 coupled to the transmission element 60.

The compound gear 170 has a second larger gear 173 fixed on the same axle and which is rotatably mounted on a shaft 174 secured to the housing 11. The second larger gear 173 is meshed with a second intermediary gear 180.

In particular, second intermediary gear 180 is a compound gear member 180. The compound gear member 180 provides a stepped gear mechanism (or double gear) whereby the gear ratio is selected to increase the rotational speed by a required amount.

The compound gear/second intermediary gear 180 provides a first smaller (inner) gear which engages with the outer large gear 173 of the first intermediary gear 170. The compound gear 180 has a second larger (outer) gear 183 fixed on the same axle and which is rotatably mounted on a shaft 184 secured to the housing 11. The second larger gear 183 provides a worm wheel which is meshed with a worm 52 of the drive system. In particular, the worm 52 is fixed to a drive shaft 51 of the motor 50.

Accordingly, the gear mechanism (gear train) comprises a worm 52 to worm gear 183 engagement wherein the worm gear 173 is a part of a second compound gear 180 comprising an inner gear meshed with an outer gear 173 of a first compound (intermediary) gear 170 which provides an inner gear 172 meshed with a driven gear 54 coupled through the clutch mechanism to the transmission element 60.

As shown in FIG. 19A, an illuminated annular ring 190 is provided around the actuation button 28 on the front of the motorised door lock 10. LEDs 192 are mounted onto a separate PCB behind the ring member 190 which illuminate either red or green to indicate different modes of operation. For example, modes include 'Pairing with the Network' used during setup, 'Unlocked' whenever the lock is in the unlocked state and 'Locked' when it is in the locked state etc. The motorised door lock 10 also emits audible tones to confirm when actions have been initiated or completed.

In this embodiment, internally the main PCB, top PCB and handle sensor PCB shown in the earlier embodiment have been replaced with a single PCB. The four battery contacts that were attached to the main casting and wired to the main PCB are now incorporated directly onto the single PCB. The handle sensor and clutch position micro-switch sensors are soldered directly to the single main PCB.

In addition, the thumb turn knob 22 that was shown attached to the clutch spindle 32 with a single fixing screw after the cast front cover had been fitted, has been replaced with a thumb turn knob 122 with a thumb turn grip 123 that is attached to the cast front cover with a circlip. When the cover is removed the thumb turn knob 122 remains captive on the cover.

As described above, the present invention includes a motorised door lock which is automatically activated when the handle on a multi-point locking system is raised. Raising the handle operates the multi point locking mechanism in the door and a cam on the door handle spindle operates a micro switch to automatically operate the lock which drives the door bolt into the frame. The present invention may include accessories for the lock which could include a separate wall mounted keypad and a wireless key fob. The present invention may also incorporate an attack sensor which may alert a user that unauthorised activity has been detected at the (remote) lock location. Such a sensor may utilise the frequency of an unauthorised attack/attempt to detect if the lock is being attacked.

The invention claimed is:

1. A door lock assembly comprising a cylinder lock, a multipoint locking mechanism and a remotely activated motorised mechanism, the multipoint locking mechanism being activated by raising a door handle and the multipoint locking mechanism being deactivated by lowering the door handle, wherein a lock bolt of the cylinder lock is extendable and retractable by each of a key, a manual turn of a thumb turn grip or the remotely activated motorised mechanism, the lock bolt only being extendable whilst the multipoint locking mechanism is engaged and the multipoint locking mechanism only being releasable whilst the lock bolt is retracted, wherein the remotely activated motorised mechanism comprises:

a motor, a worm gear, a driven gear, and rotary locking spindle engagement means to transmit movement of the motor to a rotary locking spindle of the cylinder lock, the remotely activated motorised mechanism further comprising a multipoint monitoring system to determine an operational status of the multipoint locking mechanism and a rotary lock bolt monitoring system to determine an operational status of the lock bolt; and wherein the rotary locking spindle engagement means is arranged to directly engage a component of a thumb turn mechanism of a door lock.

2. A door lock assembly according to claim 1 in which the rotary locking spindle engagement means is arranged to directly engage a component of an existing and/or preinstalled thumb turn mechanism of the door lock.

3. A door lock assembly according to claim 1 in which the rotary locking spindle engagement means is arranged to directly engage an internally projecting stub of a rotary locking spindle of an existing and preinstalled cylinder lock.

4. A door lock assembly according to claim 1 in which the rotary locking spindle engagement means comprises an engagement sleeve and the engagement sleeve is arranged to directly engage around a rotary locking spindle and in which the engagement sleeve provides an internal bore into which an end of a rotary locking spindle is engaged.

5. A door lock assembly according to claim 4 in which the engagement sleeve comprises an outer splined surface and the door lock assembly comprise an internal cylindrical splined surface for direct engagement around the engagement sleeve and wherein the internal cylindrical splined surface is provided on a transmission element.

6. A door lock assembly according to claim 1 in which the door lock assembly comprises a transmission element which is fixed to rotate with the rotary locking spindle and in which the driven gear is fixed to rotate with a drive shaft of the motor and drive from the motor is transferred to the rotary locking spindle through the engagement of the driven gear with the transmission element though a clutch mechanism.

7. A door lock assembly according to claim 6 in which the transmission element is engaged with the driven gear through a clutch mechanism and the clutch mechanism enables the transmission element to rotate with the driven gear and also to rotate relative to the driven gear.

8. A door lock assembly according to claim 7 in which the transmission element comprises a shaped boss which is located between two parallel resilient members secured to the driven gear and wherein the shaped boss is arranged to rotate with the resilient members until a threshold resistance to rotation is encountered at which point the shaped boss may rotate between the two parallel resilient members and in which the threshold resistance is achievable as a result of the driven gear attempting to rotate a worm engaged with a motor.

9. A door lock assembly according to claim 1 in which the cylinder lock comprises a Euro cylinder lock.

10. A door lock assembly according to claim 1 in which the motorised mechanism comprise control means which permits or prevents the activation of the motor and wherein the control means records the current configuration of the multipoint locking mechanism and records the current configuration of the lock bolt and in which the multipoint monitoring system determines whether locking elements of the multipoint locking mechanism are in a locked position or in an unlocked position.

11. A door lock assembly according to claim 10 in which the multipoint monitoring system monitors the movement of a handle shaft to which an internal door handle is mounted and the multipoint monitoring system records whether the handle shaft has been rotated to indicate whether the multipoint locking system has been activated or deactivated.

12. A door lock assembly according to claim 11 in which the handle shaft comprises a shaped boss and movement of the handle downwardly from a neutral position causes the shaped boss to activate a first sensor and movement of the handle upwardly from a neutral position causes the shaped boss to activate the second sensor and wherein each sensor comprises a micro switch which is arranged to close when activated and wherein, when the handle is in the neutral position, both the first micro switch and the second micro switch are open.

13. A door lock assembly according to claim 1 in which the activation of the multipoint locking system automatically activates the motorised mechanism and moves the lock bolt to the locked position.

14. A door lock assembly according to claim 1 in which the rotary locking spindle monitoring system determines whether the rotary locking spindle is in the locked and unlocked position which indicates whether the lock bolt is locked or unlocked.

15. A door lock assembly according to claim 1 in which the door lock assembly comprises a shaft secured to the rotary locking spindle and the shaft comprise a shaped boss which is engaged with a first sensor and a second sensor and wherein the first sensor and the second sensor comprise micro switches, the shaped boss provides a cam surface which is arranged to close the micro switches and movement of the rotary locking spindle to a locking position provides a locking sensor sequence and movement of the rotary locking spindle to an unlocking position provides an unlocking sensor sequence.

16. A door lock assembly according to claim 1 in which a key is only insertable and removable from an external key slot in the locked position and the unlocked position and the key has to be initially inserted and then rotated though substantially 360 degrees to lock the lock bolt and to subsequently remove the key or to unlock the lock bolt and subsequently remove the key.

17. A door lock assembly according to claim 1 in which the rotary spindle is rotatable by a key through 360 degrees between the locked position and the unlocked position and the rotary locking spindle is rotatable by the motor and a thumb turn through 180 degrees between the locked position and the unlocked position.

18. A door lock assembly according to claim 1 in which the remotely activated motorised mechanism is activated by each of a plurality of individual activators and at least by each of a smart phone, a remote control unit, a push button, a key fob or a key pad.

19. A motorised door lock assembly for use with a door having a cylinder lock and a multipoint locking mechanism, the motorised door lock assembly comprising a remotely activated motorised mechanism, wherein the motorised door lock assembly enables a lock bolt of the cylinder lock to be extendable and retractable by each of a key, a manual turn of a thumb turn grip or the remotely activated motorised mechanism, wherein the remotely activated motorised mechanism comprises:

a motor, a worm gear, a driven gear, rotary locking spindle engagement means to transmit movement of the motor to a rotary locking spindle of the cylinder lock, and a remote control actuator, the remotely activated motorised mechanism further comprising a multipoint monitoring system to determine an operational status of the multipoint locking mechanism and a rotary lock bolt monitoring system to determine an operational status of the lock bolt; and wherein the rotary locking spindle engagement means is arranged to directly engage a component of a thumb turn mechanism of a door lock.

20. A method of converting an existing door lock to a motorised door lock comprising securing a door lock assembly to the existing door lock wherein the door lock assembly is in accordance with claim 1 and wherein the method comprises directly engaging the rotary locking spindle engagement means of the door lock assembly to a thumb turn mechanism of the existing door lock.

* * * * *